US010302057B2

(12) United States Patent
Yamamoto et al.

(10) Patent No.: US 10,302,057 B2
(45) Date of Patent: May 28, 2019

(54) FUEL INJECTION DEVICE

(71) Applicant: DENSO CORPORATION, Kariya, Aichi-pref. (JP)

(72) Inventors: Shinsuke Yamamoto, Kariya (JP); Shinobu Oikawa, Kariya (JP); Tomoji Matsukawa, Kariya (JP); Moriyasu Gotoh, Nishio (JP); Eiji Itoh, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/752,278

(22) PCT Filed: Jun. 21, 2016

(86) PCT No.: PCT/JP2016/002968
§ 371 (c)(1),
(2) Date: Feb. 13, 2018

(87) PCT Pub. No.: WO2017/033370
PCT Pub. Date: Mar. 2, 2017

(65) Prior Publication Data

US 2018/0238282 A1 Aug. 23, 2018

(30) Foreign Application Priority Data

Aug. 25, 2015 (JP) ..... 2015-165656

(51) Int. Cl.
*F02M 51/06* (2006.01)
*F02M 61/10* (2006.01)
(Continued)

(52) U.S. Cl.
CPC ..... *F02M 61/10* (2013.01); *F02M 51/061* (2013.01); *F02M 51/0671* (2013.01);
(Continued)

(58) Field of Classification Search
CPC .. F02M 51/06; F02M 51/061; F02M 51/0625; F02M 51/0664; F02M 51/0671;
(Continued)

(56) References Cited

U.S. PATENT DOCUMENTS

2008/0296414 A1* 12/2008 Kubota ..... F02M 51/0675 239/533.11
2011/0057059 A1 3/2011 Yamamoto et al.
(Continued)

FOREIGN PATENT DOCUMENTS

EP 1 801 409 6/2007
JP 2010-229997 10/2010
(Continued)

OTHER PUBLICATIONS

U.S. Appl. No. 15/755,726 of Yamamoto et al., entitled "Fuel Injection Device", filed Feb. 27, 2018 (65 pages).
(Continued)

*Primary Examiner* — Darren W Gorman
(74) *Attorney, Agent, or Firm* — Nixon & Vanderhye PC

(57) ABSTRACT

A movable core is movable relative to a needle main body of a needle. A stationary core is placed on an opposite side of the movable core, which is opposite from a valve seat. A spring is operable to urge the needle and the movable core toward the valve seat. A spring seat is shaped into a ring form and is placed on a radially outer side of the needle main body at the valve seat side of the movable core. The spring is placed between the movable core and the spring seat and is operable to urge the movable core toward the stationary core. A guide is placed on the valve seat side of the movable core in an inside of a housing. An outer wall of the spring seat is slidable relative to an inner wall of the guide to guide reciprocation of the needle.

10 Claims, 10 Drawing Sheets

(51) Int. Cl.
*F02M 61/18* (2006.01)
*F02M 61/20* (2006.01)

(52) U.S. Cl.
CPC .... *F02M 51/0685* (2013.01); *F02M 61/1886* (2013.01); *F02M 61/20* (2013.01); *F02M 51/0675* (2013.01)

(58) Field of Classification Search
CPC ..... F02M 51/0675; F02M 51/0682; F02M 51/0685; F02M 61/10; F02M 61/1886; F02M 61/20; F02M 2200/304; F02M 2200/306; F02M 2200/50
See application file for complete search history.

(56) References Cited

U.S. PATENT DOCUMENTS

2013/0075501 A1* 3/2013 Miyake ..... F02M 51/0671 239/585.3
2013/0277460 A1* 10/2013 Omeri ..... F02M 51/0685 239/585.1
2014/0123946 A1* 5/2014 Grandi ..... F02M 51/066 123/445
2016/0097358 A1 4/2016 Miyake et al.
2018/0080420 A1 3/2018 Yamamoto et al.

FOREIGN PATENT DOCUMENTS

JP 2012-052418 3/2012
JP 2014-227958 12/2014

OTHER PUBLICATIONS

U.S. Appl. No. 15/749,909 of Oikawa et al., filed Feb. 2, 2018 (49 pages).

* cited by examiner

FUEL INJECTION DEVICE

CROSS REFERENCE TO RELATED APPLICATION

This application is the U.S. national phase of International Application No. PCT/JP2016/002968 filed Jun. 21, 2016 which designated the U.S. and claims priority to Japanese Patent Application No. 2015-165656 filed on Aug. 25, 2015, the entire contents of each of which are hereby incorporated by reference.

TECHNICAL FIELD

The present disclosure relates to a fuel injection device that supplies fuel at an internal combustion engine.

BACKGROUND ART

Previously, there is known a fuel injection device that forms a gap in an axial direction between a movable core and a flange of a needle in such a manner that the movable core is accelerated in the gap and collides against the flange of the needle to implement valve opening of the needle. For example, the patent literature 1 discloses the fuel injection device that includes a gap forming member, which can form the gap in the axial direction between the movable core and the flange of the needle. In this fuel injection device, the movable core, which has an increased kinetic energy that is increased through the acceleration of the movable core in the gap, collides against the flange. Therefore, even though a fuel pressure in a fuel passage in an inside of a housing receiving the needle is high, the valve opening of the needle is possible. Thereby, the high pressure fuel can be injected.

In the fuel injection device of the patent literature 1, the gap forming member is shaped into a bottomed tubular form. An inner wall of a tubular portion of the gap forming member is slidable relative to an outer wall of the flange, and an outer wall of the tubular portion is slidable relative to an inner wall of the stationary core. In this way, reciprocation of the needle in an axial direction is guided. The needle is supported by the gap forming member and the stationary core only at one end part of the needle, which is opposite from a valve seat in the axial direction.

As discussed above, in the fuel injection device of the patent literature 1, the gap forming member has a double slide structure of that both of the inner wall and the outer wall of the tubular portion of the gap forming member are configured to slide along the other members. Therefore, a total slide resistance, which is applied to the gap forming member, may possibly be increased, or wearing or uneven wearing of the slide surfaces may possibly occur upon a long time use. In this way, response of the needle may possibly be deteriorated, or reciprocation of the needle in the axial direction may possibly become unstable. Therefore, it may possibly cause variations in the injection amount of fuel injected from the fuel injection device. Furthermore, when the wear debris is generated, the wear debris may possibly be caught between corresponding members, which make relative movement therebetween, to possibly cause operational failure.

Furthermore, in the fuel injection device of the patent literature 1, the gap forming member has the double slide structure, so that the size management may become difficult, and the slide resistance may possibly vary from product-to-product. Thus, the injection amount of fuel may possibly vary among the fuel injection devices.

Furthermore, in the fuel injection device of the patent literature 1, a spring seat of an urging member, which urges the movable core toward the stationary core, is formed integrally with the housing such that the spring seat extends from the inner wall of the housing toward the radially inner side. Therefore, it is difficult to accurately set a distance between the spring seat and the movable core, and thereby the urging force of the urging member may possibly vary among the fuel injection devices. Thereby, the injection amount of fuel may possibly vary among the fuel injection devices. Here, it should be noted that a cylindrical gap is formed between an inner wall of the spring seat and an outer wall of the needle, and thereby the spring seat and the needle do not slide relative to each other.

CITATION LIST

Patent Literature

Patent Literature 1: JP2014-227958A

SUMMARY OF INVENTION

The present disclosure is made in view of the above disadvantage, and it is an objective of the present disclosure to provide a fuel injection device that can limit variations in an injection amount of fuel.

A fuel injection device of the present disclosure includes a nozzle, a housing, a needle, a movable core, a stationary core, a valve seat side urging member, a coil, a spring seat, a stationary core side urging member, and a guide.

The nozzle includes an injection hole, through which fuel is injected, and a valve seat, which is formed around the injection hole and is shaped into a ring form.

The housing is shaped into a tubular form and has one end connected to the nozzle. The housing has a fuel passage, which is formed in an inside of the housing and is communicated with the injection hole.

The needle has: a needle main body, which is shaped into a rod form; a seal portion, which is formed at one end of the needle main body such that the seal portion is contactable with the valve seat; and a flange, which is formed on a radially outer side of the needle main body at another end of the needle main body or around the another end of the needle main body. The needle is installed such that the needle is reciprocatable in the fuel passage. When the seal portion moves away from or contacts the valve seat, the needle opens or closes the injection hole.

The movable core is installed such that the movable core is movable relative to the needle main body and has a surface, which is opposite from the valve seat and is contactable with a surface of the flange located on the valve seat side.

The stationary core is installed on an opposite side of the movable core, which is opposite from the valve seat, in the inside of the housing.

The valve seat side urging member is placed on the opposite side of the needle, which is opposite from the valve seat. The valve seat side urging member is operable to urge the needle and the movable core toward the valve seat.

The coil is operable to attract the movable core toward the stationary core side such that the movable core contacts the flange and drives the needle toward the opposite side, which is opposite from the valve seat, when the coil is energized.

The spring seat is shaped into a ring form and is placed on a radially outer side of the needle main body on the valve seat side of the movable core.

The stationary core side urging member is placed between the movable core and the spring seat and has an urging force, which is smaller than an urging force of the valve seat side urging member. The stationary core side urging member is operable to urge the movable core toward the stationary core.

The guide is placed on the valve seat side of the movable core in the inside of the housing. An inner wall of the guide is slidable relative to an outer wall of the spring seat to guide reciprocation of the needle. With the above configuration, the reciprocation of the needle in the axial direction is stabilized.

As discussed above, in the present disclosure, the reciprocation of the needle main body is guided by the guide through the spring seat. That is, the spring seat does not have the double slide structure of the gap forming member of the patent literature 1. Therefore, it is possible to reduce the slide resistance, which is applied to the spring seat and the needle, and thereby it is possible to limit the wearing or uneven wearing of the slide surface upon a long time use. In this way, it is possible to limit deterioration of the response of the needle, and the axial reciprocation of the needle can be stabilized for a long time. Thus, it is possible to limit variations in the injection amount of fuel, which is injected from the fuel injection device. Furthermore, it is possible to limit generation of wear debris. Thus, it is possible to limit clamping of the wear debris between members, which make relative movement therebetween, and thereby it is possible to limit malfunctioning.

Furthermore, according to the present disclosure, at the time of guiding the reciprocation of the needle, the outer wall of the spring seat is slid relative to the inner wall of the guide. Therefore, in comparison to the double slide structure, the dimensional management of the components is eased, and it is possible to limit variations in the slide resistance from product to product. Thus, it is possible to limit variations in the injection amount of fuel from one fuel injection device to another fuel injection device.

Furthermore, according to the present embodiment, the spring seat is provided to the needle main body rather than the housing. Therefore, the distance between the spring seat and the movable core can be accurately set. Thus, it is possible to limit the variations in the urging force of the stationary core side urging member from one fuel injection device to another fuel injection device. In this way, it is possible to limit the variations in the injection amount of fuel from one fuel injection device to another fuel injection device.

DESCRIPTION OF EMBODIMENTS

Hereinafter, various embodiments of the present disclosure will be described with reference to the accompanying drawings. In the following embodiments, substantially identical structural portions will be indicated by the same reference signs and will not be redundantly described for the sake of simplicity.

(First Embodiment)

Figure 1:
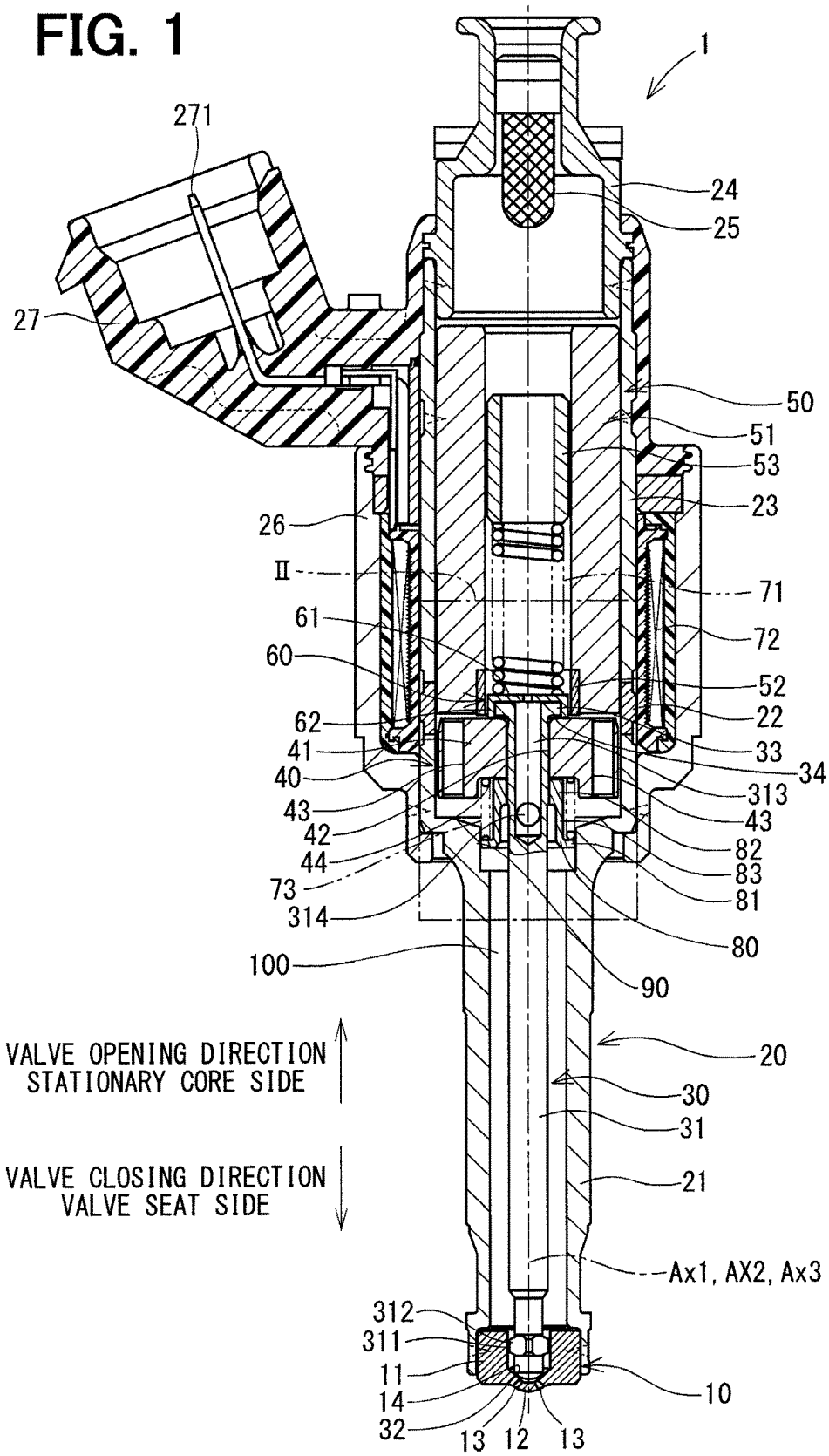
FIG. 1 is a cross-sectional view showing a fuel injection device according to a first embodiment of the present disclosure.

FIG. 1 shows a fuel injection valve according to a first embodiment of the present disclosure. A fuel injection device 1 is used in, for example, an undepicted direct injection type gasoline engine (serving as an internal combustion engine) and injects gasoline as fuel in the engine.

The fuel injection device 1 includes a nozzle 10, a housing 20, a needle 30, a movable core 40, a stationary core 50, a gap forming member 60, a spring (serving as a valve seat side urging member) 71, a coil 72, a spring seat 81, a fixing portion 82, a tubular portion 83, a spring (serving as a stationary core side urging member) 73, and a guide 90.

The nozzle 10 is made of a material, such as martensitic stainless steel, which has a relatively high hardness. The nozzle 10 is quenched to have a predetermined hardness. The nozzle 10 includes a nozzle tubular portion 11 and a nozzle bottom portion 12 while the nozzle bottom portion 12 closes one end of the nozzle tubular portion 11. The nozzle bottom portion 12 includes a plurality of injection holes 13, each of which connects between an inner surface of the nozzle bottom portion 12, which is located on the nozzle tubular portion 11 side, and an opposite surface of the nozzle bottom portion 12, which is opposite from the nozzle tubular portion 11. The inner surface of the nozzle bottom portion 12, which is located on the nozzle tubular portion 11 side, has a valve seat 14, which is formed around the injection holes 13 and is shaped into a ring form.

The housing 20 includes a first tubular portion 21, a second tubular portion 22, a third tubular portion 23, an inlet portion 24 and a filter 25.

The first tubular portion 21, the second tubular portion 22 and the third tubular portion 23 are respectively shaped into a generally cylindrical tubular form. The first tubular portion 21, the second tubular portion 22 and the third tubular portion 23 are arranged one after another in this order to share a common axis (an axis Ax1) and are joined together.

The first tubular portion 21 and the third tubular portion 23 are made of a magnetic material, such as ferritic stainless steel, and are magnetically stabilized through a magnetic stabilization process. The first tubular portion 21 and the third tubular portion 23 have a relatively low hardness. In contrast, the second tubular portion 22 is made of a non-magnetic material, such as austenitic stainless steel. A hardness of the second tubular portion 22 is higher than the hardness of the first tubular portion 21 and the third tubular portion 23.

An end part of the nozzle tubular portion 11, which is opposite from the nozzle bottom portion 12, is joined to an inside of an end part of the first tubular portion 21, which is opposite from the second tubular portion 22. The first tubular portion 21 and the nozzle 10 are joined together by, for example, welding.

The inlet portion 24 is shaped into a tubular form and is made of metal, such as stainless steel. One end of the inlet portion 24 is joined to an inside of an end part of the third tubular portion 23, which is opposite from the second tubular portion 22. The inlet portion 24 and the third tubular portion 23 are joined together by, for example, welding.

A fuel passage 100 is formed in an inside of the housing 20 and the nozzle tubular portion 11. The fuel passage 100 is connected to the injection holes 13. A pipe (not shown) is connected to an opposite side of the inlet portion 24, which is opposite from the third tubular portion 23. In this way, the fuel, which is supplied from a fuel supply source, flows into the fuel passage 100 through the pipe. The fuel passage 100 guides the fuel to the injection holes 13.

The filter 25 is placed in an inside of the inlet portion 24. The filter 25 captures foreign objects contained in the fuel, which flows into the fuel passage 100.

The needle 30 is made of a material, such as martensitic stainless steel, which has a relatively high hardness. The needle 30 is quenched to have a predetermined hardness. The hardness of the needle 30 is set to be substantially the same as the hardness of the nozzle 10.

The needle 30 is received in the inside of the housing 20 in a manner that enables reciprocation of the needle 30 in the axial direction of the axis Ax1 of the housing 20 in the fuel passage 100. The needle 30 includes a needle main body 31, a seal portion 32 and a flange 33.

The needle main body 31 is shaped into a rod form, more specifically, an elongated cylindrical form. The seal portion 32 is formed at one end of the needle main body 31, that is, the seal portion 32 is formed at a valve seat 14 side end part of the needle main body 31. The seal portion 32 is contactable with the valve seat 14. The flange 33 is shaped into a ring form and is formed at the other end of the needle main body 31, that is, the flange 33 is formed at a radially outer side of an opposite end part of the needle main body 31, which is opposite from the valve seat 14. In the present embodiment, the flange 33 is formed integrally with the needle main body 31 in one piece.

A large diameter portion 311 is formed at a location that is around the one end of the needle main body 31. An outer diameter of one end side of the needle main body 31 is smaller than an outer diameter of the other end side of the needle main body 31. The outer diameter of the large diameter portion 311 is larger than the outer diameter of the one end side of the needle main body 31. The large diameter portion 311 is formed such that an outer wall of the large diameter portion 311 is slidable relative to an inner wall of the nozzle tubular portion 11 of the nozzle 10. In this way, reciprocation of the valve seat 14 side end part of the needle 30 in the axial direction of the axis Ax1 is guided. The large diameter portion 311 has chamfered portions 312 that are formed by chamfering a plurality of circumferential parts of the outer wall of the large diameter portion 311. Thereby, the fuel can flow through gaps, each of which is formed between a corresponding one of the chamfered portions 312 and the inner wall of the nozzle tubular portion 11.

Figure 2:
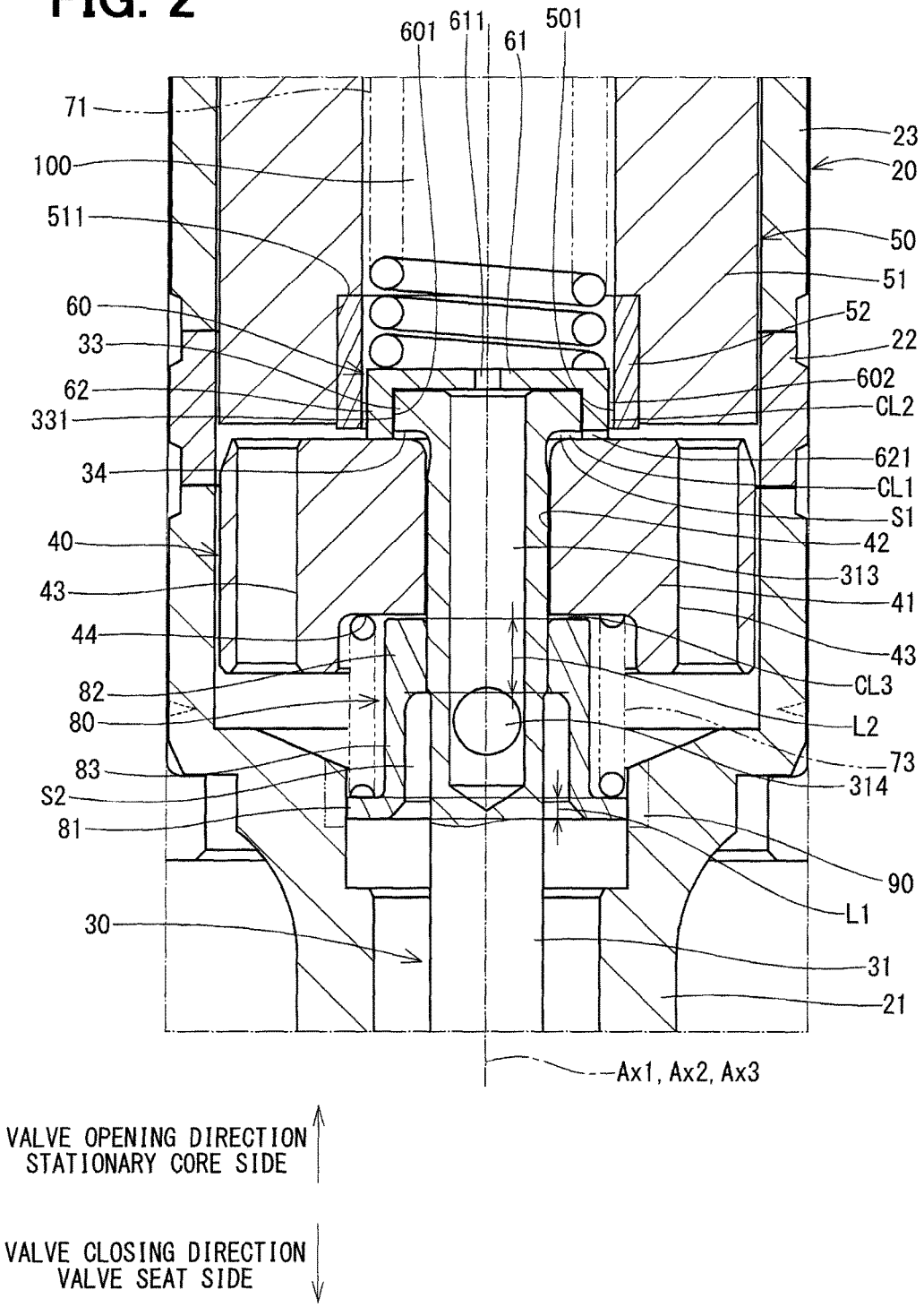
FIG. 2 is a cross-sectional view showing a movable core and its adjacent area in the fuel injection device according to the first embodiment of the present disclosure at a time of contacting a needle to a valve seat.

As shown in FIG. 2, an axial hole 313, which extends along an axis Ax2 of the needle main body 31, is formed at the other end of the needle main body 31. That is, the other end of the needle main body 31 is shaped into a hollow tubular form. Furthermore, the needle main body 31 has radial holes 314, each of which extends in a radial direction of the needle main body 31 such that the radial hole 314 communicates between a valve seat 14 side end part of the axial hole 313 and a space located at the outside of the needle main body 31. Thereby, the fuel in the fuel passage 100 can flow through the axial hole 313 and the radial holes 314. As discussed above, the needle main body 31 has the axial hole 313. The axial hole 313 extends in the axial direction of the axis Ax2 from an opposite end surface of the needle main body 31, which is opposite from the valve seat 14, and the axial hole 313 is communicated with the space outside of the needle main body 31 through the radial holes 314.

When the seal portion 32 of the needle 30 moves away (is lifted) from the valve seat 14 or contacts (is seated against) the valve seat 14, the needle 30 opens or closes the injection holes 13. Hereinafter, a direction of moving the needle 3 away from the valve seat 14 will be referred to as a valve opening direction, and a direction of contacting the needle 30 with the valve seat 14 will be referred to as a valve closing direction.

The movable core 40 includes a movable core main body 41, an axial hole 42, through-holes 43 and a recess 44. The movable core main body 41 is shaped into a generally cylindrical form and is made of a magnetic material, such as ferritic stainless steel. The movable core main body 41 is magnetically stabilized through a magnetic stabilization process. A hardness of the movable core main body 41 is relatively low and is substantially the same as the hardness of the first tubular portion 21 and the third tubular portion 23 of the housing 20.

The axial hole 42 extends along an axis Ax3 of the movable core main body 41. In the present embodiment, an inner wall of the axial hole 42 is processed through a hardening process (e.g., Ni—P plating) and a slide resistance reducing process. The through-holes 43 are formed to connect between one end surface of the movable core main body 41, which is located on the valve seat 14 side, and an opposite end surface of the movable core main body 41, which is opposite from the valve seat 14. Each of the through-holes 43 has a cylindrical inner wall. In the present embodiment, the number of the through-holes 43 is four, and these through-holes 43 are arranged one after another at equal intervals in the circumferential direction of the movable core main body 41.

The recess 44 is formed at a center of the movable core main body 41 such that the recess 44 is circular and is recessed from the end surface of the movable core main body 41, which is located on the valve seat 14 side, toward the opposite side that is opposite from the valve seat 14. The axial hole 42 opens at a bottom of the recess 44.

The movable core 40 is received in the housing 20 in a state where the needle main body 31 of the needle 30 is inserted through the axial hole 42 of the movable core 40. An inner diameter of the axial hole 42 of the movable core 40 is set to be equal to or slightly larger than the outer diameter of the needle main body 31 of the needle 30. Therefore, the movable core 40 is movable relative to the needle 30 such that the inner wall of the axial hole 42 of the movable core 40 is slid relative to an outer wall of the needle main body 31 of the needle 30. Similar to the needle 30, the movable core 40 is received in the inside of the housing 20 in a manner that enables reciprocation of the movable core 40 in the axial direction Ax1 of the housing 20 in the fuel passage 100. The fuel in the fuel passage 100 can flow through the through-holes 43.

In the present embodiment, a surface of the movable core main body 41, which is opposite from the valve seat 14, is processed through a hardening process (e.g., hard chrome plating) and an anti-abrasion process.

An outer diameter of the movable core main body 41 is set to be smaller than an inner diameter of the first tubular portion 21 and an inner diameter of the second tubular portion 22. Therefore, when the movable core 40 is reciprocated in the fuel passage 100, an outer wall of the movable core 40 is not slid relative to an inner wall of the first tubular portion 21 and an inner wall of the second tubular portion 22.

A surface of the flange 33 of the needle 30, which is located on the valve seat 14 side, is contactable with the surface of the movable core main body 41, which is located on the side that is opposite from the valve seat 14. That is, the needle 30 has a contact surface 34 that is contactable with the surface of the movable core main body 41, which is located on the side that is opposite from the valve seat 14. The movable core 40 is formed such that the movable core 40 is movable relative to the needle 30 in such a manner that the movable core 40 is contactable with the contact surface 34 or is movable away from the contact surface 34.

With respect to the movable core 40 placed in the inside of the housing 20, the stationary core 50 is coaxial with the housing 20 and is located on the opposite side of the movable core 40, which is opposite from the valve seat 14. The stationary core 50 includes a stationary core main body 51 and a bush 52. The stationary core main body 51 is shaped into a generally cylindrical tubular form and is made of a magnetic material, such as ferritic stainless steel. The stationary core main body 51 is magnetically stabilized through a magnetic stabilization process. A hardness of the stationary core main body 51 is relatively low and is substantially the same as the hardness of the movable core main body 41. The stationary core main body 51 is fixed to the inner side of the housing 20. The stationary core main body 51 and the third tubular portion 23 of the housing 20 are welded together.

The bush 52 is shaped into a generally cylindrical tubular form and is made of a material, such as martensitic stainless steel, which has a relatively high hardness. The bush 52 is installed to a recess 511 that is radially outwardly recessed from an inner wall of a valve seat 14 side end part of the stationary core main body 51. An inner diameter of the bush 52 is generally the same as an inner diameter of the stationary core main body 51. An end surface of the bush 52, which is located on the valve seat 14 side, is placed on the valve seat 14 side of an end surface of the stationary core main body 51, which is located on the valve seat 14 side. Therefore, the surface of the movable core main body 41, which is opposite from the valve seat 14, is contactable with the end surface of the bush 52, which is located on the valve seat 14 side.

The stationary core 50 is formed such that in the state where the seal portion 32 contacts the valve seat 14, the flange 33 of the needle 30 is placed in the inside of the bush 52. An adjusting pipe 53, which is shaped into a cylindrical tubular form, is press fitted to an inner side of the stationary core main body 51 (see FIG. 1).

The gap forming member 60 is made of, for example, a non-magnetic material. A hardness of the gap forming member 60 is set to be generally the same as the hardness of the needle 30 and the hardness of the bush 52.

The gap forming member 60 is placed on the opposite side of the needle 30 and the movable core 40, which is opposite from the valve seat 14. The gap forming member 60 includes a plate portion 61 and an extending portion 62. The plate portion 61 is shaped into a generally circular plate form. The plate portion 61 is placed on the opposite side of the needle 30, which is opposite from the valve seat 14, in the inside of the stationary core 50 such that one end surface of the plate portion 61 is contactable with the needle 30, more specifically, an end surface of the needle main body 31, which is opposite from the valve seat 14, and an end surface of the flange 33 of the needle 30, which is opposite from the valve seat 14.

The extending portion 62 is formed integrally with the plate portion 61 in one piece such that the extending portion 62 is shaped into a cylindrical tubular form and extends from an outer peripheral edge part of the one end surface of the plate portion 61 toward the valve seat 14. That is, in the present embodiment, the gap forming member 60 is shaped into a bottomed cylindrical tubular form. The gap forming member 60 is placed such that the flange 33 of the needle 30 is placed in the inside of the extending portion 62. Furthermore, an end part of the extending portion 62, which is opposite from the plate portion 61, is contactable with the surface of the movable core main body 41, which is located on the stationary core 50 side.

In the present embodiment, the extending portion 62 is formed such that an axial length of the extending portion 62 is larger than an axial length of the flange 33. Therefore, in a state where the plate portion 61 contacts the needle 30, and the extending portion 62 contacts the movable core 40, an axial gap CL1, which is a gap in the axial direction of the axis Ax1, is formed between the flange 33 and the movable core 40.

An inner diameter of the extending portion 62 is set to be equal to or slightly larger than an outer diameter of the flange 33. Therefore, an inner side wall surface 601 of the gap forming member 60, which is a wall surface of an inner wall of the extending portion 62, i.e., a wall surface that is opposed to a flange outer wall surface 331 (a portion of an outer wall of the flange 33), is slidable relative to the flange outer wall surface 331.

Furthermore, an outer diameter of the plate portion 61 and the extending portion 62 is set to be smaller than the inner diameter of the bush 52 of the stationary core 50. Therefore, an outer side wall surface 602 of the gap forming member 60, which is a wall surface of an outer wall of the plate portion 61 and the extending portion 62 that is opposed to a stationary core inner wall surface 501 of a portion of an inner wall of the bush 52 of the stationary core 50, forms a radial gap CL2 (a gap formed in the radial direction) between the outer side wall surface 602 and the stationary core inner wall surface 501. Thus, the outer side wall surface 602 of the gap forming member 60 is not slid relative to the stationary core inner wall surface 501 (the inner wall of the bush 52).

In the present embodiment, since the extending portion 62 is shaped into the tubular form, an annular space S1 (a space shaped into an annular form) is formed by the contact surface 34 of the flange 33, the movable core 40 and the inner wall of the extending portion 62 in the state where the extending portion 62 and the movable core 40 contact with each other.

The gap forming member 60 further includes a hole 611. The hole 611 connects between one end surface of the plate portion 61 and the other end surface of the plate portion 61 and is communicatable with the axial hole 313 of the needle 30. Therefore, the fuel, which is located on the opposite side of the gap forming member 60 that is opposite from the valve seat 14 in the fuel passage 100, can flow to the valve seat 14 side of the movable core 40 through the hole 611, the axial hole 313 of the needle 30, and the radial holes 314 of the needle 30. An inner diameter of the hole 611 is smaller than the inner diameter of the bush 52 and an inner diameter of the axial hole 313. Therefore, when the needle 30 is moved together with the gap forming member 60 to the opposite side, which is opposite from the valve seat 14, i.e., when the needle 30 is moved in the valve opening direction, the fuel, which is located on the opposite side of the gap forming member 60 that is opposite from the valve seat 14, flows into the axial hole 313 after a flow of the fuel is restricted through the hole 611. In this way, it is possible to limit an excessive increase in the moving speed of the needle 30 in the valve opening direction.

The spring 71 is, for example, a coil spring and is placed on the opposite side of the gap forming member 60, which is opposite from the valve seat 14. One end of the spring 71 contacts the end surface of the plate portion 61 of the gap forming member 60, which is opposite from the extending portion 62. The other end of the spring 71 contacts the adjusting pipe 53. The spring 71 urges the gap forming member 60 toward the valve seat 14. In the state where the plate portion 61 of the gap forming member 60 contacts the needle 30, the spring 71 can urge the needle 30 toward the valve seat 14, i.e., in the valve closing direction through the gap forming member 60. Furthermore, in the state where the extending portion 62 of the gap forming member 60 contacts the movable core 40, the spring 71 can urge the movable core 40 toward the valve seat 14 through the gap forming member 60. That is, the spring 71 can urge the needle 30 and the movable core 40 toward the valve seat 14 through the gap forming member 60. An urging force of the spring 71 is adjusted by adjusting a location of the adjusting pipe 53 relative to the stationary core 50.

The coil 72 is shaped into a generally cylindrical tubular form and is arranged such that the coil 72 surrounds a radially outer side of the housing 20, particularly, a radially outer side of the second tubular portion 22 and the third tubular portion 23. When the coil 72 receives (energized with) an electric power, the coil 72 generates a magnetic force. When the coil 72 generates the magnetic force, the stationary core main body 51, the movable core main body 41, the first tubular portion 21 and the third tubular portion 23 form a magnetic circuit. In this way, a magnetic attractive force is generated between the stationary core main body 51 and the movable core main body 41, so that the movable core 40 is magnetically attracted to the stationary core 50 side. At this time, the movable core 40 is moved in the valve opening direction while the movable core 40 is accelerated in the axial gap CL1, and thereafter the movable core 40 collides against the contact surface 34 of the flange 33 of the needle 30. Therefore, the needle 30 is moved in the valve opening direction, so that the seal portion 32 is moved away from the valve seat 14, thereby resulting in the valve opening of the needle 30. As a result, the injection holes 13 are opened. As discussed above, by energizing the coil 72, the movable core 40 is magnetically attracted to the stationary core 50 side, and thereby the movable core 40 contacts the flange 33 and moves the needle 30 toward the opposite side that is opposite from the valve seat 14.

As discussed above, according to the present embodiment, in the valve closing state, the gap forming member 60 forms the axial gap CL1 between the flange 33 and the movable core 40. Therefore, at the time of energizing the coil 72, the movable core 40 can collide with the flange 33 after acceleration of the movable core 40 in the axial gap CL1. In this way, even in a case where the pressure in the fuel passage 100 is relatively high, the valve opening is possible without increasing the electric power supplied to the coil 72.

When the movable core 40 is magnetically attracted toward the stationary core 50 (in the valve opening direction) by the magnetic attractive force, the end surface of the movable core main body 41, which is located on the stationary core 50 side, collides with the end surface of the bush 52, which is located on the valve seat 14 side. In this way, the movement of the movable core 40 in the valve opening direction is limited.

As shown in FIG. 1, a radially outer side of the inlet portion 24 and a radially outer side of the third tubular portion 23 are molded with resin. A connector 27 is formed at this molded portion. Terminals 271, which supply the electric power to the coil 72, are insert molded in the connector 27. A holder 26, which is shaped into a tubular form, is placed on a radially outer side of the coil 72 such that the holder 26 covers the coil 72.

In the present embodiment, the spring seat 81 and the fixing portion 82 are joined together through the tubular portion 83. The spring seat 81, the fixing portion 82 and the tubular portion 83 are made of metal, such as stainless steel, and are formed integrally in one piece. In the following description of the present embodiment, a member, in which the spring seat 81, the fixing portion 82 and the tubular portion 83 are formed integrally in one piece, will be also referred to as a specific member 80. That is, the specific member 80 includes the spring seat 81, the fixing portion 82 and the tubular portion 83. A hardness of the specific member 80 is set to be lower than the hardness of the needle 30 and is the same as the hardness of the first tubular portion 21.

The spring seat 81 is shaped into an circular ring plate form and is placed on the valve seat 14 side of the movable core 40 at a location that is on the radially outer side of the needle main body 31.

The fixing portion 82 is shaped into a circular ring form and placed between the movable core 40, which is located on one side of the fixing portion 82, and the spring seat 81 and the radial hole 314, which are located on the other side of the fixing portion 82, at a location that is on the radially outer side of the needle main body 31. An inner wall of the fixing portion 82 is fitted to the outer wall of the needle main body 31, and thereby the fixing portion 82 is fixed to the needle main body 31.

The tubular portion 83 is shaped into a cylindrical tubular form. One end of the tubular portion 83 is connected to the spring seat 81, and the other end of the tubular portion 83 is connected to the fixing portion 82. In this way, the spring seat 81 is fixed to the radially outer side of the needle main body 31 at the location, which is on the valve seat 14 side of the movable core 40. That is, the specific member 80 is fixed to the needle main body 31 through the press fitting of the fixing portion 82 to the needle main body 31.

In the present embodiment, the spring seat 81 is formed such that a plate thickness of the spring seat 81, i.e., an axil length L1 of the spring seat 81 is smaller than an axial length L2 of the fixing portion 82.

The spring 73 is, for example, a coil spring and is placed such that one end of the spring 73 contacts the spring seat 81, and the other end of the spring 73 contacts the bottom of the recess 44 of the movable core 40. The spring 73 can urge the movable core 40 toward the stationary core 50. An urging force of the spring 73 is smaller than the urging force of the spring 71. The urging force of the spring 73 is adjustable by adjusting a relative position of the spring seat 81 relative to the needle main body 31, i.e., a press fitting position of the fixing portion 82 to the needle main body 31.

The guide 90 is placed on the valve seat 14 side of the movable core 40 at the inside of the housing 20. The guide 90 is located at a position that corresponds to the spring seat 81 in the axial direction of the axis Ax1 of the housing 20. In the present embodiment, similar to the first tubular portion 21 of the housing 20, the guide 90 is made of a magnetic material, such as ferritic stainless steel, and is shaped into a cylindrical tubular form. In the present embodiment, the guide 90 is formed integrally with the first tubular portion 21.

An inner diameter of the guide 90 is set to be equal to or slightly larger than the outer diameter of the spring seat 81. Therefore, an outer wall of the spring seat 81 is slidable relative to an inner wall of the guide 90. In this way, the guide 90 can guide the reciprocation of the needle 30 in the axial direction through the spring seat 81.

In the present embodiment, the valve seat 14 side end part of the needle 30 is reciprocatably supported by the inner wall of the nozzle tubular portion 11 of the nozzle 10, and a stationary core 50 side part (a part that corresponds to the position of the spring seat 81) of the needle 30 is reciprocatably supported by the guide 90. As discussed above, the reciprocation of the needle 30 in the axial direction is guided at the two locations that are placed one after another in the axial direction of the axis Ax1 of the housing 20.

The spring 71 urges the gap forming member 60 toward the valve seat 14, so that the plate portion 61 of the gap forming member 60 contacts the needle 30, and thereby the seal portion 32 of the needle 30 is urged against the valve seat 14. At this time, the spring 73 urges the movable core 40 toward the stationary core 50, so that the extending portion 62 of the gap forming member 60 contacts the movable core 40. In this state, the axial gap CL1 is formed between the contact surface 34 of the flange 33 of the needle 30 and the movable core 40, and a gap CL3 is formed between the bottom of the recess 44 of the movable core 40 and the fixing portion 82 (see FIG. 2).

The movable core 40 is reciprocatable in the axial direction between the flange 33 (the contact surface 34) of the needle 30 and the fixing portion 82. The bottom of the recess 44 of the movable core 40 is contactable with a movable core 40 side end part of the fixing portion 82. The fixing portion 82 can limit the relative movement of the movable core 40 relative to the needle 30 toward the valve seat 14 through contact of the fixing portion 82 with the movable core 40.

Furthermore, in the present embodiment, a cylindrical space S2, which is a space in a cylindrical form, is formed between the tubular portion 83 and the spring seat 81, which are located on one side of the cylindrical space S2, and the needle main body 31, which is located on the other side of the cylindrical space S2. The radial holes 314 of the needle 30 are communicated with the cylindrical space S2. Thus, the fuel in the axial hole 313 can flow toward the valve seat 14 side of the spring seat 81 through the radial holes 314 and the cylindrical space S2.

In the present embodiment, in the state where the movable core 40 is magnetically attracted toward the stationary core 50, when the energization of the coil 72 is stopped, the needle 30 and the movable core 40 are urged toward the valve seat 14 by the urging force of the spring 71 conducted through the gap forming member 60. In this way, the needle 30 moves in the valve closing direction, so that the seal portion 32 contacts the valve seat 14 and is thereby valve-closed. Thus, the injection holes 13 are closed.

After the contacting of the seal portion 32 with the valve seat 14, the movable core 40 is moved relative to the needle 30 toward the valve seat 14 by inertia. At this time, the fixing portion 82 can limit excess movement of the movable core 40 toward the valve seat 14 through contact of the fixing portion 82 with the movable core 40. In this way, the deterioration of the response at the next valve opening time can be limited. Furthermore, the shock at the time of contacting of the movable core 40 to the fixing portion 82 can be reduced by the urging force of the spring 73, and thereby it is possible to limit the secondary valve opening, which is caused by bouncing of the needle 30 at the valve seat 14. Furthermore, the movement of the movable core 40 toward the valve seat 14 is limited by the fixing portion 82, so that it is possible to limit excessive compression of the spring 73. Thus, it is possible to limit the secondary valve opening that is caused by recollision of the movable core 40 against the flange 33 due to urging of the movable core 40 in the valve opening direction by a restoring force of the spring 73, which is excessively compressed.

In the present embodiment, the gap forming member 60 further includes a passage 621. The passage 621 is formed in a form of a groove that is recessed from a movable core 40 side end part of the extending portion 62 toward the plate portion 61. The passage 621 connects between the inner wall and the outer wall of the extending portion 62. In this way, at the time of contacting the extending portion 62 with the movable core 40, the fuel in the annular space S1 can flow to the outside of the extending portion 62 through the passage 621. Furthermore, the fuel at the outside of the extending portion 62 can flow into the inside of the extending portion 62, i.e., the annular space S1 through the passage 621. Thus, at the time of contacting the extending portion 62 with the movable core 40, it is possible to limit a damper effect that is generated due to presence of the fuel in the annular space S1. Therefore, it is possible to limit a reduction of a kinetic energy of the movable core 40 at the time of colliding the movable core 40 against the contact surface 34 of the flange 33.

The fuel, which is supplied from the inlet portion 24, flows through the stationary core 50, the adjusting pipe 53, the hole 611 of the gap forming member 60, the axial hole 313 of the needle 30, the radial holes 314, the cylindrical space S2, the gap between the first tubular portion 21 and the needle 30, and the gap between the nozzle 10 and the needle 30, i.e., the fuel passage 100 and is guided to the injection holes 13. At the time of operating the fuel injection device 1, an area around the movable core 40 is filled with the fuel. Furthermore, at the time of operating the fuel injection device 1, the fuel flows through the through-holes 43 of the movable core 40. Therefore, the movable core 40 can smoothly reciprocate in the axial direction at the inside of the housing 20.

Next, an assembling method of the needle 30, the movable core 40, the specific member 80 and the spring 73 will be described.

(Movable Core Assembling Step)

First of all, the movable core 40 and the needle 30 are assembled together by inserting the needle main body 31 through the axial hole 42 of the movable core 40 such that the seal portion 32 side end part of the needle main body 31 is first inserted into the axial hole 42 of the movable core 40.

(Spring Assembling Step)

Next, the spring 73 is assembled by inserting the needle main body 31 through the inside of the spring 73 such that the seal portion 32 side end part of the needle main body 31 is first inserted into the inside of the spring 73.

(Specific Member Assembling Step)

Next, the fixing portion 82 is press fitted to the needle main body 31 by inserting the needle main body 31 into the inside of the fixing portion 82 of the specific member 80 such that the seal portion 32 side end part of the needle main body 31 is first inserted into the inside of the fixing portion 82 of the specific member 80. At this time, a relative position (a press fitting position) of the specific member 80 relative to the needle main body 31 is adjusted such that a distance between the flange 33 and the fixing portion 82 becomes a predetermined size.

By executing the above steps, it is possible to obtain an assembly, which includes the needle 30, the movable core 40, the specific member 80 and the spring 73 that are assembled together.

Next, the operation of the fuel injection device 1 of the present embodiment will be described with reference to FIGS. 2 to 5.

As shown in FIG. 2, when the coil 72 is not energized, the seal portion (32) of the needle 30 contacts the valve seat (14), while the plate portion 61 of the gap forming member 60 contacts the needle 30, and the extending portion 62 of the gap forming member 60 contacts the movable core 40. At this time, the axial gap CL1, which has the predetermined size, is formed between the contact surface 34 of the flange 33 and the movable core 40.

When the coil 72 is energized in the state shown in FIG. 2, the movable core 40 is magnetically attracted to the stationary core 50 and is thereby moved toward the stationary core 50 while the movable core 40 upwardly pushes the gap forming member 60 and is accelerated in the axial gap CL1. The movable core 40, which is accelerated in the axial gap CL1 and is thereby in the increased kinetic energy state, collides against the contact surface 34 of the flange 33 (see FIG. 3). In this way, the needle 30 is moved in the valve opening direction, so that the seal portion (32) is moved away from the valve seat (14), thereby resulting in the valve opening. Thus, the injection of the fuel from the injection holes 13 begins. At this time, the axial gap CL1 becomes zero. Furthermore, the gap CL3 is increased in comparison to the state shown in FIG. 2.

Figure 3:
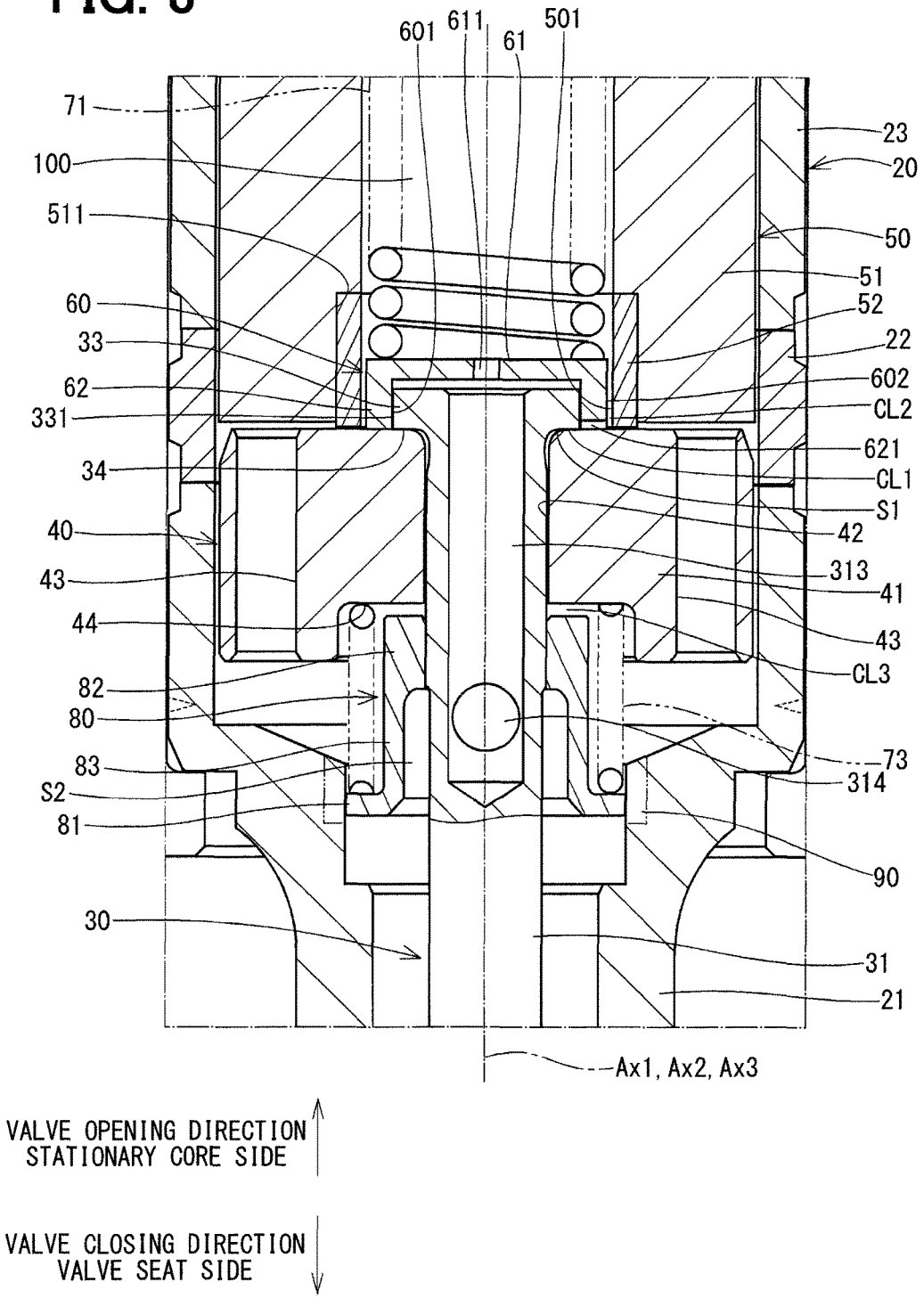
FIG. 3 is a cross-sectional view showing the movable core and its adjacent area in the fuel injection device according to the first embodiment of the present disclosure at a time of contacting a movable core to a flange during a valve opening time.

When the movable core 40 is further moved toward the stationary core 50 from the state shown in FIG. 3, the movable core 40 contacts the bush 52. Thereby, the movement of the movable core 40 in the valve opening direction is limited. At this time, the needle 30 is further moved in the valve opening direction by the inertia and contacts the plate portion 61 of the gap forming member 60 (see FIG. 4).

Figure 4:
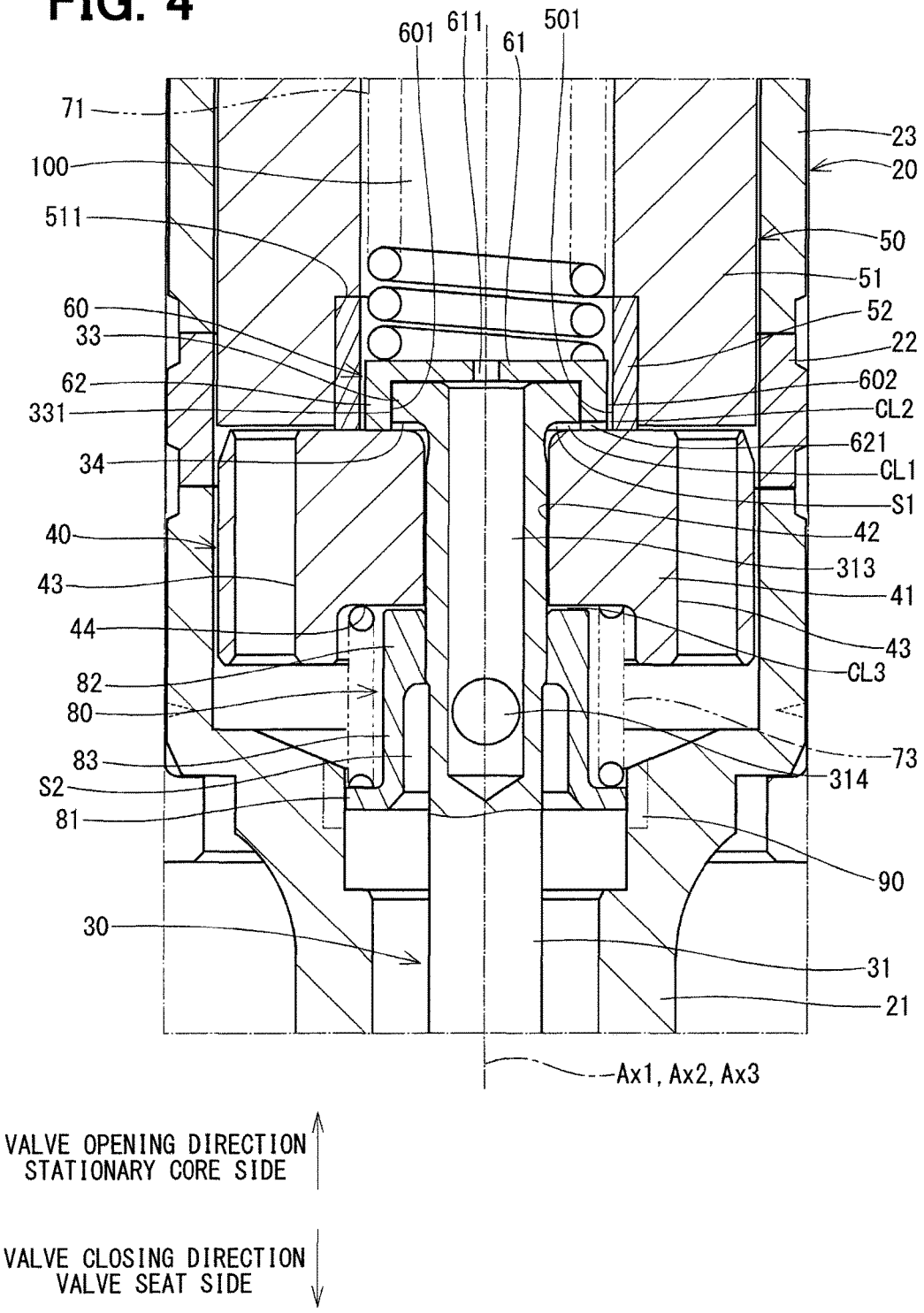
FIG. 4 is a cross-sectional view showing the movable core and its adjacent area in the fuel injection device according to the first embodiment of the present disclosure at a time of contacting the movable core to a stationary core during the valve opening time.
Figure 5:
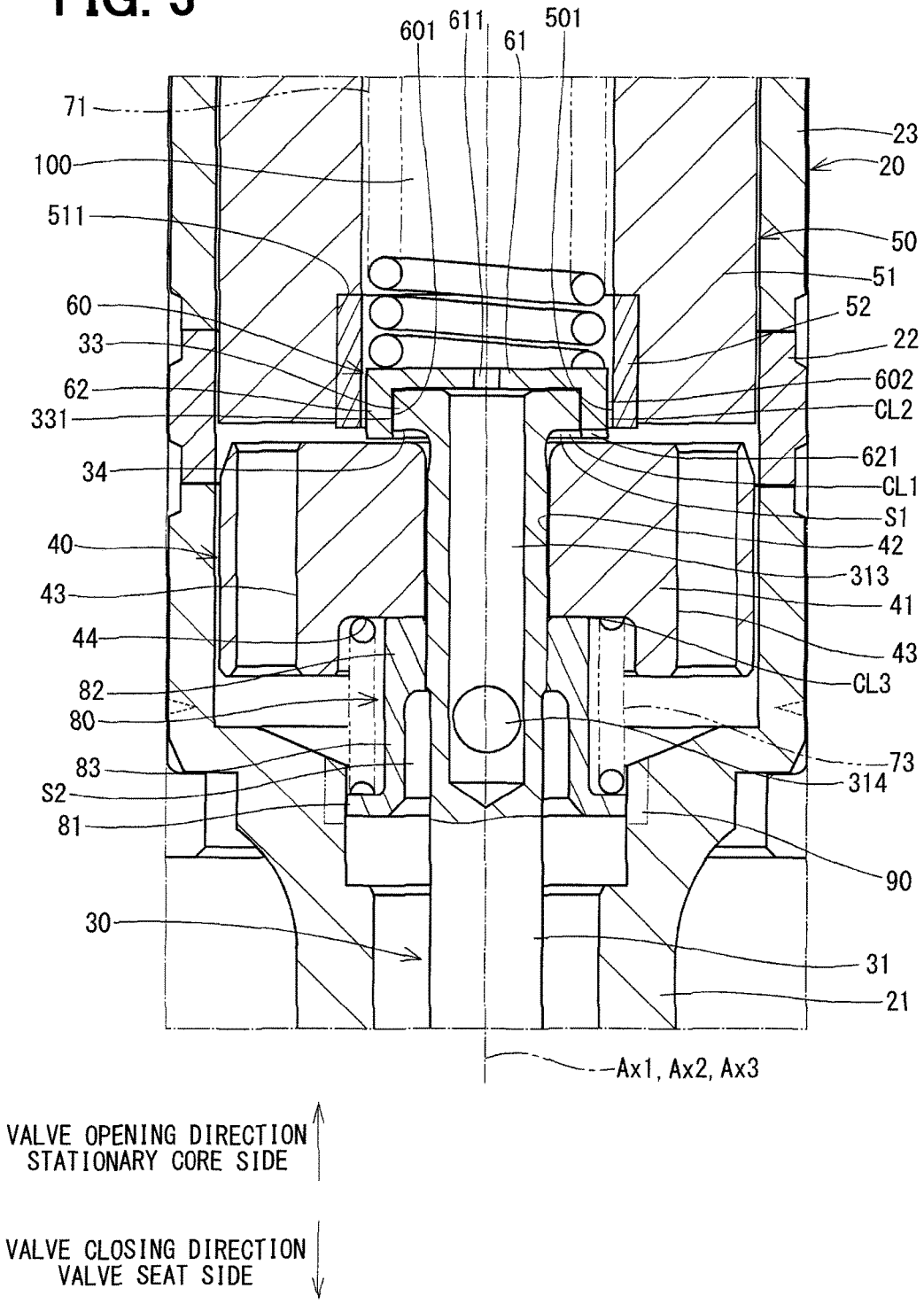
FIG. 5 is a cross-sectional view showing the movable core and its adjacent area in the fuel injection device according to the first embodiment of the present disclosure at a time of contacting the movable core to a fixing portion during a valve closing time.

In a state shown in FIG. 4, when the energization of the coil 72 is stopped, the movable core 40 and the needle 30 are moved in the valve closing direction by the urging force of the spring 71 conducted through the gap forming member 60. When the seal portion (32) of the needle 30 contacts the valve seat (14) and is thereby valve-closed, the movable core 40 is further moved in the valve closing direction by the inertia and contacts the fixing portion 82 (see FIG. 5). Thereby, the movement of the movable core 40 in the valve closing direction is limited. At this time, the movable core 40 is spaced from the extending portion 62 of the gap forming member 60. Furthermore, the gap CL3 becomes zero. Thereafter, the movable core 40 is moved in the valve opening direction by the urging force of the spring 73 and contacts the extending portion 62 of the gap forming member 60 (see FIG. 2).

As discussed above, (1) according to the present embodiment, the nozzle 10 includes the injection holes 13, through which the fuel is injected, and the valve seat 14, which is formed around the injection holes 13 and is shaped into the ring form.

The housing 20 is shaped into the tubular form and has the one end connected to the nozzle 10, and the housing 20 has the fuel passage 100, which is formed in the inside of the housing 20 and is communicated with the injection holes 13.

The needle 30 has: the needle main body 31, which is shaped into the rod form; the seal portion 32, which is formed at the one end of the needle main body 31 such that the seal portion 32 is contactable with the valve seat 14; and the flange 33, which is formed on the radially outer side of the other end of the needle main body 31. The needle 30 is installed such that the needle 30 is reciprocatable in the fuel passage 100, and when the seal portion 32 moves away from or contacts the valve seat 14, the needle 30 opens or closes the injection holes 13.

The movable core 40 is installed such that the movable core 40 is movable relative to the needle main body 31 and has the surface, which is opposite from the valve seat (14) and is contactable with the surface (the contact surface 34) of the flange 33 located on the valve seat 14 side.

The stationary core 50 is installed on the opposite side of the movable core 40, which is opposite from the valve seat 14, in the inside of the housing 20.

The spring 71 is placed on the opposite side of the needle 30, which is opposite from the valve seat 14, and the spring 71 is operable to urge the needle 30 and the movable core 40 toward the valve seat 14.

The coil 72 is operable to attract the movable core 40 toward the stationary core 50 such that the movable core 40 contacts the flange 33 and drives the needle 30 toward the opposite side, which is opposite from the valve seat 14, when the coil 72 is energized.

The spring seat 81 is shaped into the ring form and is placed on the radially outer side of the needle main body 31 on the valve seat 14 side of the movable core 40.

The spring 73 is placed between the movable core 40 and the spring seat 81 and has the urging force, which is smaller than the urging force of the spring 71. The spring 73 is operable to urge the movable core 40 toward the stationary core 50.

The guide 90 is placed on the valve seat 14 side of the movable core 40 in the inside of the housing 20. The outer wall of the spring seat 81 is slidable relative to the inner wall of the guide 90 to guide reciprocation of the needle 30. With the above construction, the reciprocation of the needle 30 in the axial direction is stabilized.

As discussed above, according to the present embodiment, the reciprocation of the needle main body 31 is guided by the guide 90 through the spring seat 81. That is, the spring seat 81 does not have the double slide structure of the gap forming member of the patent literature 1. Therefore, it is possible to reduce the slide resistance, which is applied to the spring seat 81 and the needle 30, and thereby it is possible to limit the wearing or uneven wearing of the slide surface upon a long time use. In this way, it is possible to limit deterioration of the response of the needle 30, and the axial reciprocation of the needle 30 can be stabilized for a long time. Thus, it is possible to limit variations in the injection amount of fuel, which is injected from the fuel injection device 1. Furthermore, it is possible to limit generation of wear debris. Thus, it is possible to limit clamping of the wear debris between the members, which make relative movement therebetween, and thereby it is possible to limit malfunctioning.

Furthermore, according to the present embodiment, at the time of guiding the reciprocation of the needle 30, the outer wall of the spring seat 81 is slid relative to the inner wall of the guide 90. Therefore, in comparison to the double slide structure, the dimensional management of the components is eased, and it is possible to limit variations in the slide resistance from product to product. Thus, it is possible to limit variations in the injection amount of fuel from one fuel injection device 1 to another fuel injection device 1.

Furthermore, according to the present embodiment, the spring seat 81 is provided to the needle main body 31 rather than the housing 20. Therefore, the distance between the spring seat 81 and the movable core 40 can be accurately set. Thus, it is possible to limit the variations in the urging force of the spring 73 from one fuel injection device 1 to another fuel injection device 1. In this way, it is possible to limit the variations in the injection amount of fuel from one fuel injection device 1 to another fuel injection device 1.

Furthermore, the fuel injection device 1 of the present embodiment further includes the gap forming member 60. The gap forming member 60 includes: the plate portion 61 that is placed on the opposite side of the needle 30, which is opposite from the valve seat 14, such that the one end surface of the plate portion 61 is contactable with the needle 30; and the extending portion 62 that is formed to extend from the plate portion 61 toward the valve seat 14 side, while the opposite end part of the extending portion 62, which is opposite from the plate portion 61, is contactable with the surface of the movable core 40 located on the stationary core 50 side. The gap forming member 60 is configured to form the axial gap CL1, which is a gap defined in the axial direction between the flange 33 and the movable core 40, when the plate portion 61 and the extending portion 62 contact the needle 30 and the movable core 40, respectively. Therefore, at the time of magnetically attracting the movable core 40 toward the stationary core 50 through the energization of the coil 72, the movable core 40 can collide against the flange 33 after accelerating the movable core 40 in the axial gap CL1. In this way, the movable core 40, which has the increased kinetic energy through the acceleration of the movable core 40 in the axial gap CL1, can collide against the flange 33. Therefore, even when the fuel pressure in the fuel passage 100 is high, the valve opening of the needle 30 is possible. Thus, the high pressure fuel can be injected.

Furthermore, (3) according to the present embodiment, the gap forming member 60 is formed such that the inner side wall surface 601 of the gap forming member 60, which is a wall surface opposed to the flange outer wall surface 331 that is a part of the outer wall of the flange 33, is slidable relative to the flange outer wall surface 331, and the outer side wall surface 602 of the gap forming member 60, which is a wall surface opposed to the stationary core inner wall surface 501 that is a part of the inner wall of the stationary core 50, forms the radial gap CL2, which is a gap defined in the radial direction, between the outer side wall surface 602 of the gap forming member 60 and the stationary core inner wall surface 501.

As discussed above, according to the present embodiment, among the inner side wall surface 601 and the outer side wall surface 602 of the gap forming member 60, only the inner side wall surface 601 slides relative to the other member (the flange 33), and the outer side wall surface 602 does not slide relative to the other member (the stationary core 50). Thus, the total slide resistance, which is applied to the gap forming member 60, can be reduced.

In the embodiment discussed above, the gap forming member 60 is constructed such that the inner side wall surface 601 slides relative to the flange outer wall surface 331. Therefore, the radial movement of the gap forming member 60 relative to the needle 30 is limited. Thereby, it is possible to limit the sliding of the outer side wall surface 602 of the gap forming member 60 relative to the stationary core inner wall surface 501 (the inner wall of the bush 52).

Furthermore, (4) the fuel injection device 1 of the present embodiment further includes the fixing portion 82. The fixing portion 82 is shaped into the ring form. The fixing portion 82 is fixed to the radially outer side of the needle main body 31 at the location between the movable core 40 and the spring seat 81 and is connected to the spring seat 81. In this way, the spring seat 81 is fixed to the radially outer side of the needle main body 31.

Furthermore, (5) according to the present embodiment, the fixing portion 82 is contactable with the surface of the movable core 40 located on the valve seat 14 side to limit movement of the movable core 40 toward the valve seat 14 side. In this way, the deterioration of the response at the next valve opening time can be limited. Furthermore, the shock at the time of contacting the movable core 40 to the fixing portion 82 can be reduced by the urging force of the spring 73, and thereby it is possible to limit the secondary valve opening, which is caused by bouncing of the needle 30 at the valve seat 14. Furthermore, the movement of the movable core 40 toward the valve seat 14 is limited by the fixing portion 82, so that it is possible to limit excessive compression of the spring 73. Thus, it is possible to limit the secondary valve opening that is caused by recollision of the movable core 40 against the flange 33 due to urging of the movable core 40 in the valve opening direction by the restoring force of the spring 73, which is excessively compressed.

Furthermore, (6) the fuel injection device 1 of the present embodiment further includes the tubular portion 83. The tubular portion 83 is shaped into the tubular form and joins between the spring seat 81 and the fixing portion 82. The tubular portion 83 and the inner wall of the spring seat 81 form the cylindrical space S2 between: the tubular portion 83 and the inner wall of the spring seat 81; and the outer wall of the needle main body 31. Therefore, when the needle 30 is moved in the valve closing direction, the fuel flows from the valve seat 14 side into the cylindrical space S2. In this way, it is possible to limit an excessive increase in the moving speed of the needle 30 at the time of moving the needle 30 in the valve closing direction. Therefore, it is possible to limit the secondary valve opening caused by the bouncing of the needle 30 at the valve seat 14.

(Second Embodiment)

Figure 6:
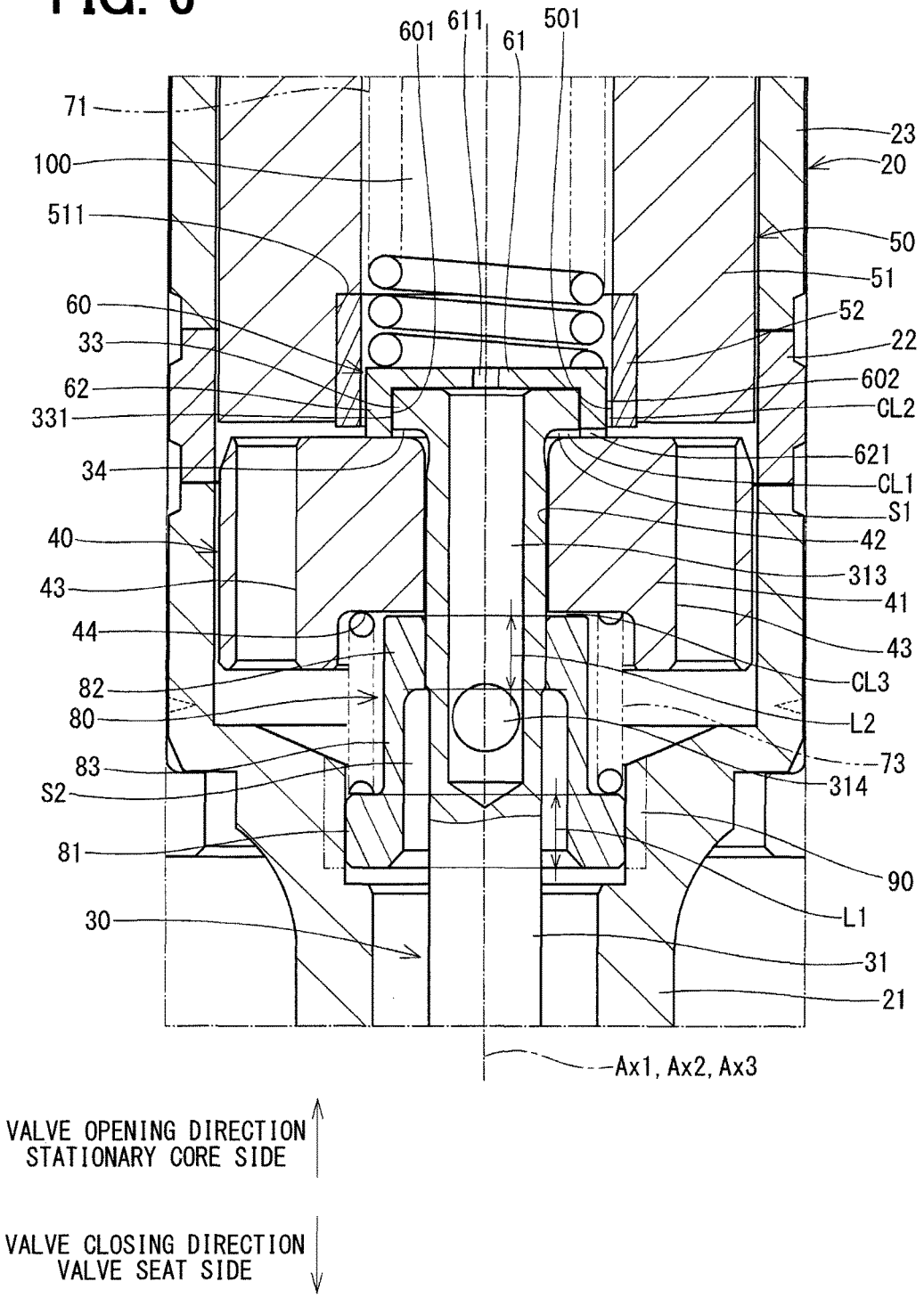
FIG. 6 is a cross-sectional view showing a movable core and its adjacent area in a fuel injection device according to a second embodiment of the present disclosure.

FIG. 6 shows a portion of the fuel injection device according to a second embodiment of the present disclosure. The second embodiment differs from the first embodiment with respect to the shape of the spring seat 81.

In the second embodiment, the spring seat 81 is formed such that the plate thickness, i.e., the axil length L1 of the spring seat 81 coincides with the axial length L2 of the fixing portion 82. Furthermore, corners of two opposite end parts of the spring seat 81, which are opposite to each other in the axial direction, are chamfered.

As discussed above, (7) in the present embodiment, the spring seat 81 is formed such that the axil length L1 of the spring seat 81 coincides with the axial length L2 of the fixing portion 82. Thus, a slide length, along which the spring seat 81 and the guide 90 are slid relative to each other, is longer than that of the first embodiment. Thereby, the guide 90 can more stably guide the axial reciprocation of the needle 30.

Furthermore, in the present embodiment, the corners of the opposite end parts of the spring seat 81, which are opposite to each other in the axial direction, are chamfered. Therefore, at the time of reciprocating the needle 30 in the axial direction, it is possible to limit sticking of the corners of the spring seat 81 to the inner wall of the guide 90. In this way, it is possible to limit operational failure of the needle 30.

(Third Embodiment)

Figure 7:
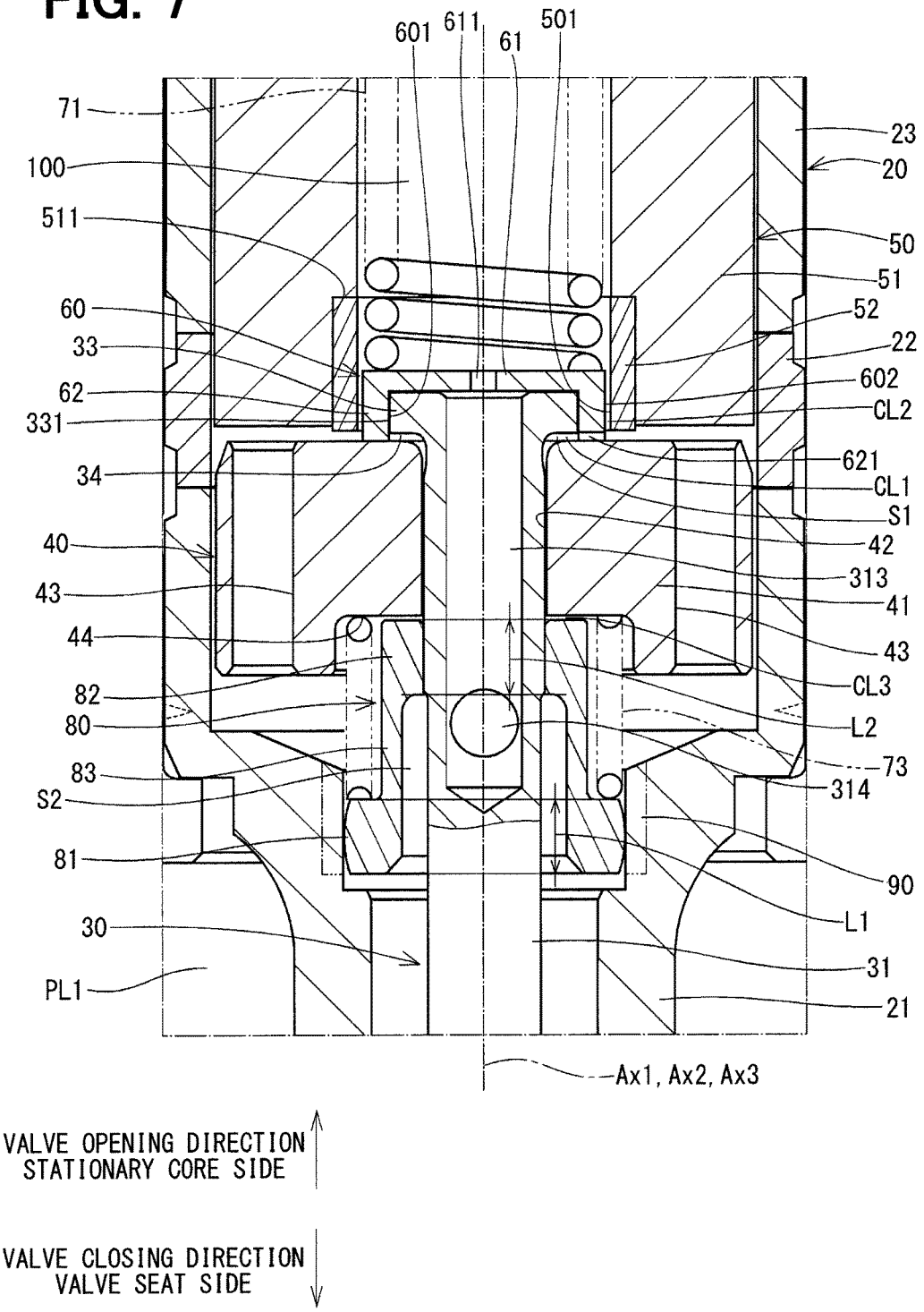
FIG. 7 is a cross-sectional view showing a movable core and its adjacent area in a fuel injection device according to a third embodiment of the present disclosure.

FIG. 7 shows a portion of the fuel injection device according to a third embodiment of the present disclosure. The third embodiment differs from the second embodiment with respect to the shape of the spring seat 81.

In the third embodiment, the spring seat 81 is formed such that an outline of the outer wall of the spring seat 81 is in a form of a curved line that protrudes toward the inner wall of the guide 90 in a cross section of the spring seat 81, which is taken along an imaginary plane PL1 that includes the axis Ax1. That is, the outer wall of the spring seat 81, which is slid relative to the inner wall of the guide 90, is in a form of a curved surface that is curved in the axial direction of the axis Ax1.

As discussed above, (9) in the present embodiment, the spring seat 81 is formed such that the outline of the outer wall of the spring seat 80 is in the form of the curved line that protrudes toward the inner wall of the guide 90 in the cross section of the spring seat 81, which is taken along the imaginary plane PL1 that includes the axis Ax1. Therefore, it is possible to implement the structure that limits the slide movement of the corners of the outer peripheral edges of the end parts of the spring seat 81, which are opposite to each other in the axial direction, along the inner wall of the guide 90. In this way, at the time of reciprocating the needle 30 in the axial direction, it is possible to limit sticking of the corners of the spring seat 81 to the inner wall of the guide 90. Thus, it is possible to limit the operational failure of the needle 30.

(Fourth Embodiment)

Figure 8:
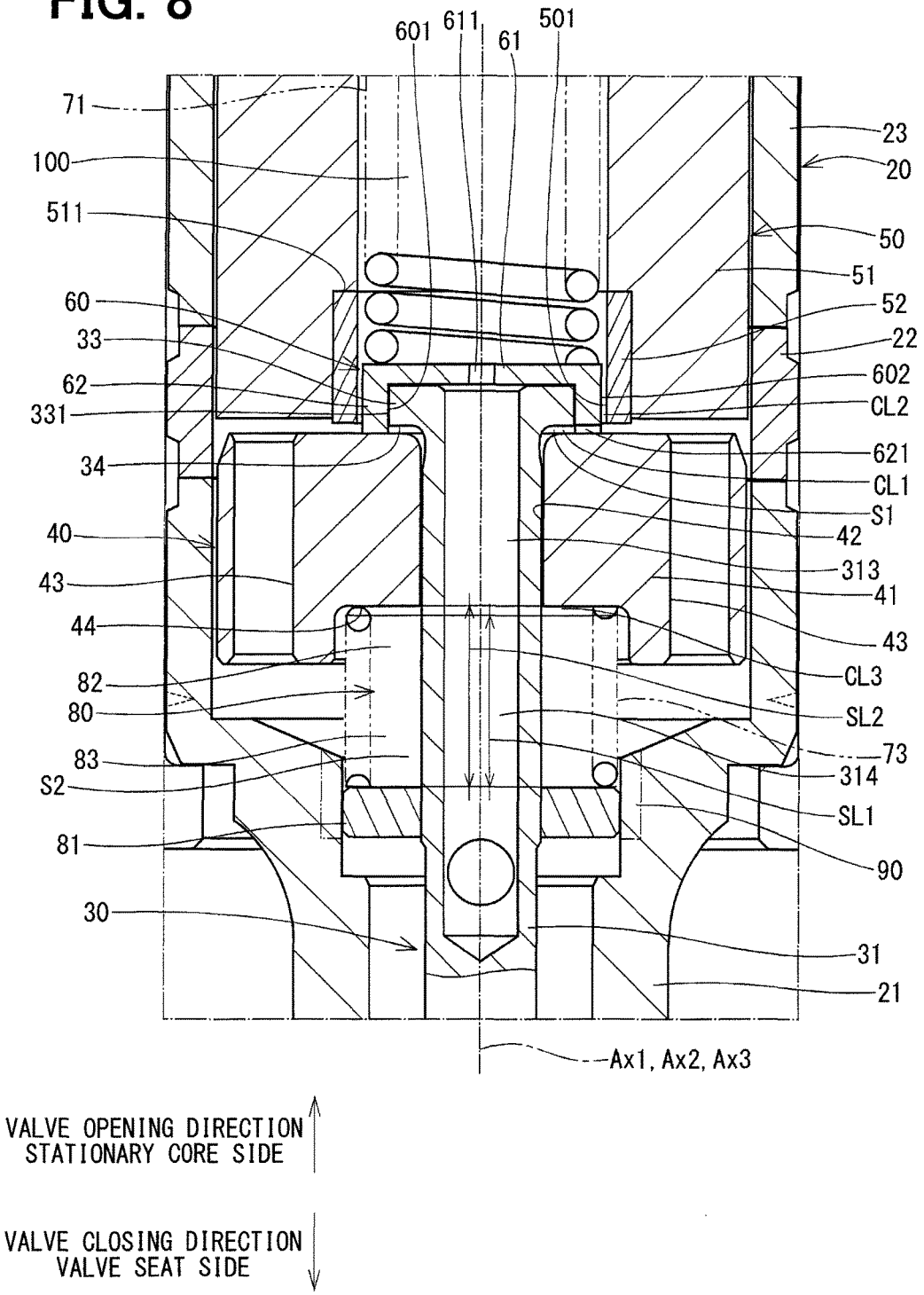
FIG. 8 is a cross-sectional view showing a movable core and its adjacent area in a fuel injection device according to a fourth embodiment of the present disclosure.

FIG. 8 shows a portion of the fuel injection device according to a fourth embodiment of the present disclosure. The fourth embodiment differs from the second embodiment with respect to the shape of the specific member 80 and the shape of the needle 30.

In the fourth embodiment, the fuel injection device does not include the fixing portion 82 and the tubular portion 83 shown in the second embodiment. That is, the specific member 80 is made only of the spring seat 81.

The inner wall of the spring seat 81 is fitted to the outer wall of the needle main body 31, and thereby the spring seat 81 is fixed to the needle main body 31. That is, the spring seat 81 is press fitted to the needle main body 31, and thereby the specific member 80 is fixed to the needle main body 31. Furthermore, corners of two opposite end parts of the spring seat 81, which are opposite to each other in the axial direction, are chamfered.

In the present embodiment, the radial holes 314 of the needle 30 are formed on the valve seat 14 side of the spring seat 81. Therefore, the fuel in the axial hole 313 can flow toward the valve seat 14 side of the spring seat 81 through the radial holes 314.

Furthermore, in the present embodiment, the spring 73 is formed such that a solid length SL2 of the spring 73 becomes a predetermined length while the solid length SL2 of the spring 73 is a length of the spring 73 in the axial direction measured in a state where a gap between axially adjacent helical segments of a wire of the spring 73 becomes zero by tightly contacting the axially adjacent helical segments of the wire of the spring 73 with each other in the axial direction. The solid length SL1 is set to be smaller than a distance between the movable core 40 and the spring seat 81 in the state where the plate portion 61 of the gap forming member 60 contacts the needle 30, and the extending portion 62 contacts the movable core 40. That is, the solid length SL1 is set to be smaller than the length SL2 of the spring 73 in this state. Therefore, at the valve closing time, when the movable core 40 is moved in the valve closing direction by the inertia after contacting of the seal portion 32 against the valve seat 14, the length of the spring 73 becomes the solid length SL1. Thus, the movement of the movable core 40 in the valve closing direction, i.e., toward the valve seat 14 is limited. In this way, the deterioration of the response at the next valve opening time can be limited.

The assembling method of the needle 30, the movable core 40, the specific member 80 and the spring 73 of the present embodiment is the same as that of the first embodiment and thereby will not be described for the sake of simplicity.

As discussed above, according to the present embodiment, although the fixing portion 82 and the tubular portion 83 are not provided, there is provided the spring seat 81 that is slidable relative to the inner wall of the guide 90. In this way, the reciprocation of the needle main body 31 is guided by the guide 90 through the spring seat 81.

(Fifth Embodiment)

Figure 9:
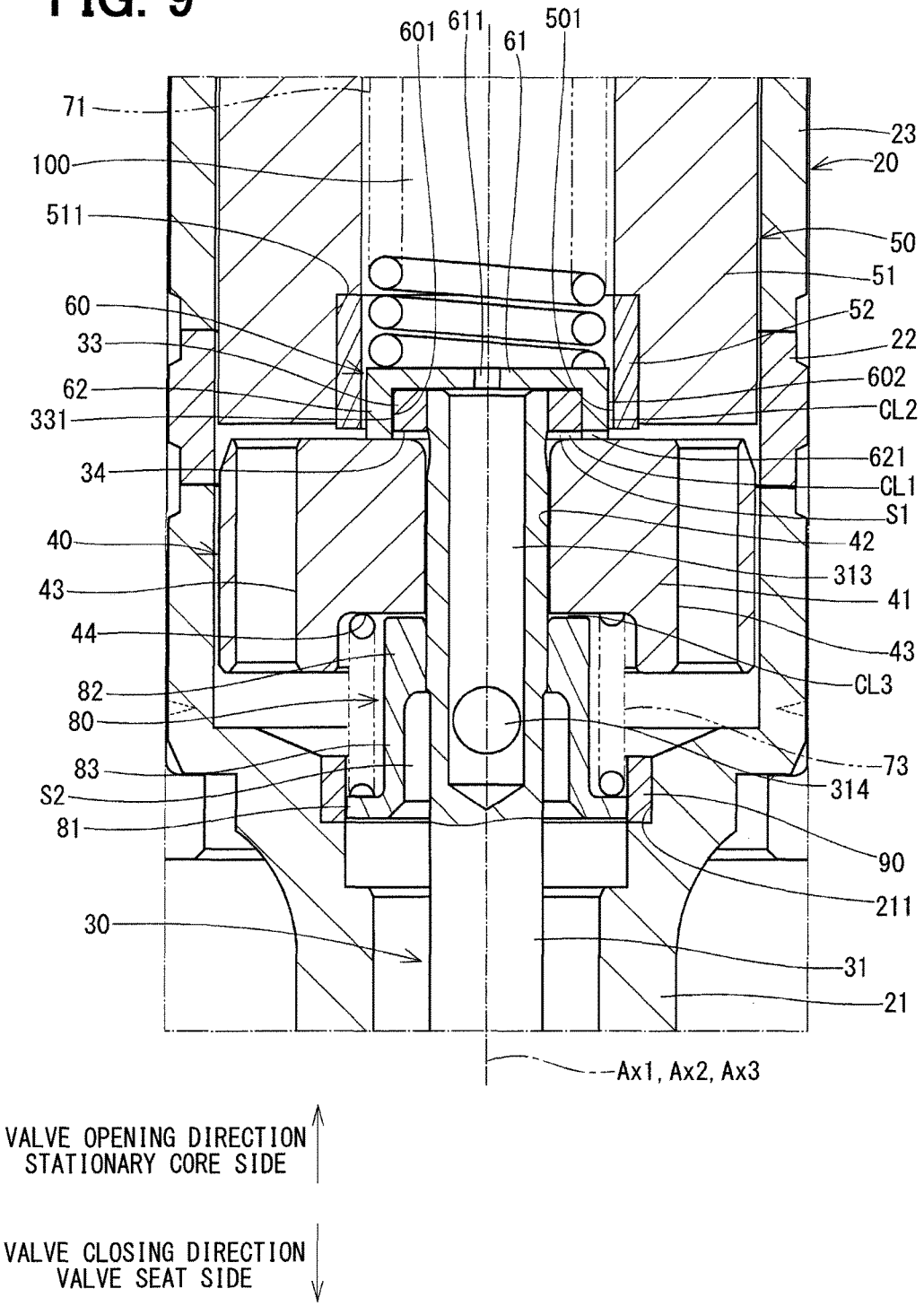
FIG. 9 is a cross-sectional view showing a movable core and its adjacent area in a fuel injection device according to a fifth embodiment of the present disclosure.

FIG. 9 shows a portion of the fuel injection device according to a fifth embodiment of the present disclosure. The fifth embodiment differs from the first embodiment with respect to the structures of the flange 33, the specific member 80 and the guide 90.

In the fifth embodiment, the flange 33 is formed separately from the needle main body 31. The flange 33 is made of the same material as that of the needle main body 31, i.e., is made of the material, such as the martensitic stainless steel, which has the relatively high hardness. The flange 33 is fixed to an end part of the needle main body 31, which is opposite from the valve seat 14, by way of press fitting or welding.

Furthermore, in the present embodiment, the specific member 80 is made of the same material as that of the needle main body 31, i.e., is made of the material, such as the martensitic stainless steel, which has the relatively high hardness. The specific member 80 is fixed to the needle main body 31 by, for example, press fitting or welding the fixing portion 82 relative to the needle main body 31.

Furthermore, in the present embodiment, the guide 90 is formed separately from the first tubular portion 21. The guide 90 is made of the same material as that of the spring seat 81, i.e., is made of the material, such as the martensitic stainless steel, which has the relatively high hardness. The guide 90 is shaped into a cylindrical tubular form and is installed to a recess 211 that is radially outwardly recessed from the inner wall of the first tubular portion 21.

Next, an assembling method of the needle 30, the movable core 40, the specific member 80 and the spring 73 will be described.

(Specific Member Assembling Step)

The specific member 80 is assembled by inserting the needle main body 31 through the inside of the fixing portion 82 of the specific member 80, and then press fitting or welding the fixing portion 82 to the needle main body 31. At this time, a relative position (a press fitting position or a welding position) of the specific member 80 relative to the needle main body 31 is adjusted such that a distance between an end surface of the needle main body 31, which is opposite from the seal portion 32, and the fixing portion 82 becomes a predetermined size.

(Spring Assembling Step)

Next, the spring 73 is assembled by inserting the needle main body 31 through the inside of the spring 73 such that the end part of the needle main body 31, which is opposite from the seal portion 32, is first inserted into the inside of the spring 73.

(Movable Core Assembling Step)

Next, the movable core 40 is assembled by inserting the needle main body 31 into the axial hole 42 of the movable core 40 such that the end part of the needle main body 31, which is opposite from the seal portion 32, is first inserted into the axial hole 42 of the movable core 40.

(Flange Assembling Step)

Next, the needle main body 31 is inserted into the flange 33 such that the end part of the needle main body 31, which is opposite from the seal portion 32, is first inserted into the flange 33, and the flange 33 is press fitted or welded to the needle main body 31. At this time, the relative position (the press fitting position or the welding position) of the flange 33 relative to the needle main body 31 is adjusted such that the end surface of the flange 33, which is opposite from the valve seat 14, is generally flush with the end surface of the needle main body 31, which is opposite from the valve seat 14.

By executing the above steps, it is possible to obtain the assembly that is formed by integrally assembling the needle 30, the specific member 80, the spring 73, the movable core 40 and the flange 33 together. As described above, according to the present embodiment, the guide 90 is formed separately from the first tubular portion 21 and is made of the same material as that of the spring seat 81, i.e., is made of the material, such as the martensitic stainless steel, which has the relative high hardness. Therefore, it is possible to limit wearing caused by the slide movement between the outer wall of the spring seat 81 and the inner wall of the guide 90.

(Sixth Embodiment)

Figure 10:
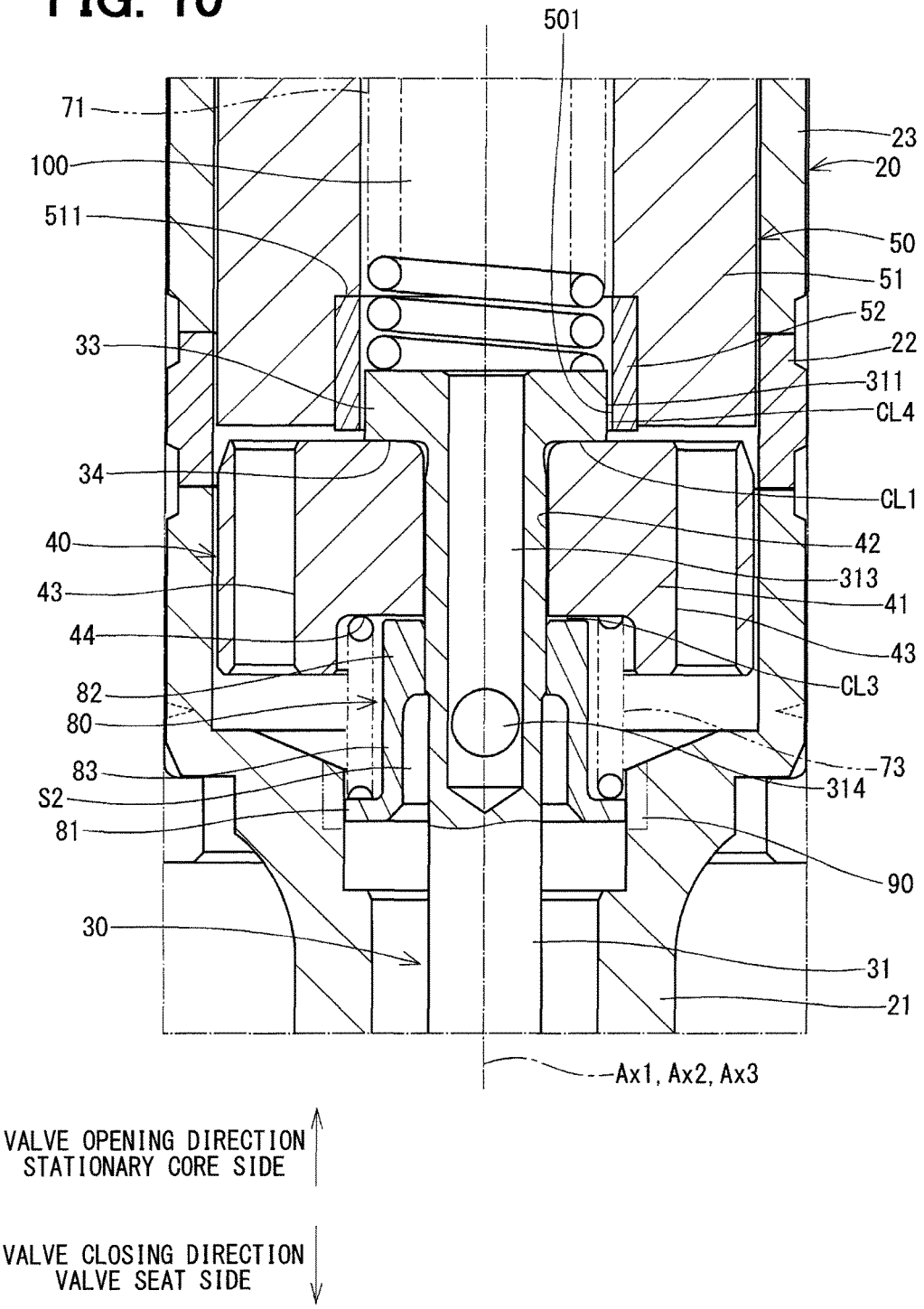
FIG. 10 is a cross-sectional view showing a movable core and its adjacent area in a fuel injection device according to a sixth embodiment of the present disclosure.

FIG. 10 shows a portion of the fuel injection device according to a sixth embodiment of the present disclosure. The sixth embodiment is different from the first embodiment with respect to that the gap forming member 60 is not provided. In the sixth embodiment, the gap forming member 60, which is discussed in the first embodiment, is not provided. Thus, the spring 71 is arranged such that the valve seat 14 side end part of the spring 71 contacts the flange 33, and the spring 71 urges the needle 30 toward the valve seat 14. Furthermore, the flange 33 is formed such that the contact surface 34 of the flange 33 is placed on the valve seat 14 side of the end surface of the bush 52, which is located on the valve seat 14 side, in the state (valve closing time) where the seal portion 32 contacts the valve seat 14 (see FIG. 10). Therefore, in the state where the seal portion 32 contacts the valve seat 14, the surface of the movable core 40, which is opposite from the valve seat 14, contacts the contact surface 34. Specifically, the axial gap CL1 between the flange 33 and the movable core 40 is zero. Furthermore, at this time, the gap CL3 is formed between the bottom of the recess 44 of the movable core 40 and the fixing portion 82.

Furthermore, in the present embodiment, the flange 33 forms a radial gap CL4, which is a gap that is formed between the outer wall of the flange 33 and the inner wall of the bush 52 in the radial direction. Therefore, the outer wall of the flange 33 does not slide along the inner wall of the bush 52.

In the present embodiment, the axial gap CL1 at the valve closing time is zero. Therefore, when the movable core 40 is magnetically attracted through the operation of the coil 72, the movable core 40 is not accelerated in the axial gap CL1 unlike the first embodiment. As a result, the present embodiment is less advantageous with respect to the injection of the high pressure fuel in comparison to the first embodiment. However, in the sixth embodiment, similar to the first embodiment, the movable core 40 is arranged to be movable relative to the needle main body 31 and can form the gap CL3 between the movable core 40 and the fixing portion 82. Furthermore, the spring 73, which urges the movable core 40 toward the stationary core 50, is provided. Therefore, it is possible to limit the bouncing of the needle 30 at the time of colliding the seal portion 32 against the valve seat 14, and thereby it is possible to limit unintentional secondary valve opening.

(Other Embodiments)

In another embodiment of the present disclosure, the distance between the end surface of the fixing portion 82, which is located on the stationary core 50 side, and the end surface of the spring seat 81, which is located on the stationary core 50 side, may be smaller than the solid length of the spring 73. In such a case, when the movable core 40 moves in the valve closing direction by the inertia after contacting of the seal portion 32 to the valve seat 14 at the valve closing time, the length of the spring 73 becomes the solid length. Thereby, the movement of the movable core 40 in the valve closing direction is limited. At this time, the movable core 40 does not contact the fixing portion 82.

Furthermore, in the above embodiment, there is discussed the example where the corners of the two opposite end parts of the spring seat 81, which are opposite to each other in the axial direction, are chamfered. In contrast, in another embodiment of the present disclosure, the corner of only one of the two opposite end parts of the spring seat 81, which are opposite to each other in the axial direction, may be chamfered.

Furthermore, in another embodiment of the present disclosure, the spring seat 81 may be formed such that the corner of at least one of the two opposite end parts of the spring seat 81, which are opposite to each other in the axial direction, is chamfered like in the second embodiment, and the outline of the outer wall of the spring seat 81 is in the form of the curved line that protrudes toward the inner wall of the guide 90 in the cross section of the spring seat 81, which is taken along the imaginary plane PL1 that includes the axis Ax1, like in the third embodiment.

Furthermore, in another embodiment of the present disclosure, the stationary core main body 51 may not have the recess 511, and the stationary core 50 may not have the bush 52. In such a case, the end surface of the movable core 40, which is opposite from the valve seat 14, may be configured to contact the end surface of the stationary core main body 51, which is located on the valve seat 14 side.

Furthermore, in the above embodiment, there is discussed the example where the extending portion 62 of the gap forming member 60 is shaped into the tubular form. In contrast, in another embodiment of the present disclosure, the shape of the extending portion 62 should not be limited to the tubular form. For example, the extending portion 62 may be in a form of a plurality of rods, each of which has the inner side wall surface 601 and the outer side wall surface 602.

Furthermore, in the above embodiment, there is discussed the example where the nozzle 10 and the housing 20 (the first tubular portion 21) are formed separately. In contrast, in another embodiment of the present disclosure, the nozzle 10 and the housing 20 (the first tubular portion 21) may be formed integrally in one piece. Furthermore, the third tubular portion 23 and the stationary core main body 51 may be formed integrally in one piece.

Furthermore, in the above embodiment, there is discussed the example where the flange 33 is formed at the other end of the needle main body 31. In contrast, in another embodiment of the present disclosure, the flange 33 may be formed at a radially outer side of an adjacent part of the needle main body 31, which is adjacent to the other end of the needle main body 31. In such a case, the plate portion 61 of the gap forming member 60 does not contact the flange 33 and contacts only to the needle main body 31.

Furthermore, in the above embodiment, there is discussed the example where the through-holes 43 are formed in the movable core 40. In contrast, in another embodiment of the present disclosure, the through-holes 43 may not be formed in the movable core 40. In such case, although the moving speed of the movable core 40 at the initial stage of the energization is reduced, the excess moving speed of the movable core 40 can be limited. Thereby, this structure is advantageous in terms of limiting the overshooting of the need at the full lift time, limiting the bouncing of the movable core 40 at the full lift time, and limiting the bouncing at the valve closing time.

The application of the present disclosure should not be limited to a direct injection type gasoline engine. For example, the present disclosure may be applied to a port injection type gasoline engine or a diesel engine.

As discussed above, the present disclosure should not be limited to the above embodiments and may be embodied in various other forms without departing from the principle of the present disclosure.

The invention claimed is:

1. A fuel injection device comprising:

a nozzle that includes an injection hole, through which fuel is injected, and a valve seat, which is formed around the injection hole and is shaped into a ring form;

a housing that is shaped into a tubular form and has one end connected to the nozzle, wherein the housing has a fuel passage, which is formed in an inside of the housing and is communicated with the injection hole;

a needle that has:

a needle main body, which is shaped into a rod form;

a seal portion, which is formed at one end of the needle main body such that the seal portion is contactable with the valve seat; and a flange, which is formed on a radially outer side of the needle main body at another end of the needle main body or around the another end of the needle main body, wherein the needle is installed such that the needle is reciprocatable in the fuel passage, and when the seal portion moves away from or contacts the valve seat, the needle opens or closes the injection hole;

a movable core that is installed such that the movable core is movable relative to the needle main body and has a surface, which is opposite from the valve seat and is contactable with a surface of the flange located on the valve seat side;

a stationary core that is installed on an opposite side of the movable core, which is opposite from the valve seat, in the inside of the housing;

a valve seat side spring that is placed on the opposite side of the needle, which is opposite from the valve seat, wherein the valve seat side spring is operable to urge the needle and the movable core toward the valve seat;

a coil that is operable to attract the movable core toward the stationary core such that the movable core contacts the flange and drives the needle toward the opposite side, which is opposite from the valve seat, when the coil is energized;

a spring seat that is shaped into a ring form and is placed on a radially outer side of the needle main body on the valve seat side of the movable core;

a stationary core side spring that is placed between the movable core and the spring seat and has an urging force, which is smaller than an urging force of the valve seat side spring, wherein the stationary core side spring is operable to urge the movable core toward the stationary core; and a guide that is placed on the valve seat side of the movable core in the inside of the housing, wherein an outer wall of the spring seat is slidable relative to an inner wall of the guide to guide reciprocation of the needle.

2. The fuel injection device according to claim 1, further comprising a gap forming member that has:

a plate portion that is placed on the opposite side of the needle, which is opposite from the valve seat, such that one end surface of the plate portion is contactable with the needle; and an extending portion that is formed to extend from the plate portiontoward the valve seat side, while an opposite end part of the extending portion, which is opposite from the plate portion, is contactable with the surface of the movable corelocated on the stationary core side, wherein the gap forming member is configured to form an axial gap, which is a gap defined in an axial direction between the flange and the movable core, when the plate portion and the extending portion contact the needle and the movable core, respectively.

3. The fuel injection device according to claim 2, wherein the gap forming member is formed such that an inner side wall surface of the gap forming member, which is a wall surface opposed to a flange outer wall surface that is a part of an outer wall of the flange, is slidable relative to the flange outer wall surface, and an outer side wall surface of the gap forming member, which is a wall surface opposed to a stationary core inner wall surface that is a part of an inner wall of the stationary core, forms a radial gap, which is a gap defined in a radial direction, between the outer side wall surface of the gap forming member and the stationary core inner wall surface.

4. The fuel injection device according to claim 1, further comprising a fixing portion that is shaped into a ring form, wherein the fixing portion is fixed to a radially outer side of the needle main body at a location between the movable core and the spring seat and is connected to the spring seat.

5. The fuel injection device according to claim 4, wherein the fixing portion is contactable with a surface of the movable core located on the valve seat side to limit movement of the movable core toward the valve seat.

6. The fuel injection device according to claim 4, further comprising a tubular portion, which is shaped into a tubular form and joins between the spring seat and the fixing portion, wherein the tubular portion and an inner wall of the spring seat form a cylindrical space between:

the tubular portion and the inner wall of the spring seat; and an outer wall of the needle main body.

7. The fuel injection device according to claim 4, wherein the spring seat is formed such that an axil length of the spring seat is equal to an axial length of the fixing portion.

8. The fuel injection device according to claim 1, wherein a corner of at least one of two opposite end parts of the spring seat, which are opposite to each other in an axial direction, is chamfered.

9. The fuel injection device according to claim 1, wherein the spring seat is formed such that a profile of the outer wall of the spring seat is curved to project toward the inner wall of the guide in a cross section thereof taken along an imaginary plane, which includes an axis.

10. The fuel injection device according to claim 1, wherein the guide is formed separately from the housing.

* * * * *